US010507375B2

(12) United States Patent
Sandusky

(10) Patent No.: US 10,507,375 B2
(45) Date of Patent: Dec. 17, 2019

(54) SKATEBOARD BASE PLATE AND ASSOCIATED SYSTEMS

(71) Applicant: DJLL Holdings, LLC, Landenberg, PA (US)

(72) Inventor: Donald A. Sandusky, Landenberg, PA (US)

(73) Assignee: DJLL Holdings, LLC, Landenberg, PA (US)

( * ) Notice: Subject to any disclaimer, the term of this patent is extended or adjusted under 35 U.S.C. 154(b) by 0 days.

(21) Appl. No.: 16/102,151

(22) Filed: Aug. 13, 2018

(65) Prior Publication Data

US 2019/0054366 A1 Feb. 21, 2019

Related U.S. Application Data

(60) Provisional application No. 62/547,404, filed on Aug. 18, 2017, provisional application No. 62/558,820, filed on Sep. 14, 2017, provisional application No. 62/616,857, filed on Jan. 12, 2018.

(51) Int. Cl.
*A63C 17/01* (2006.01)
*A63C 17/00* (2006.01)

(52) U.S. Cl.
CPC ..... *A63C 17/012* (2013.01); *A63C 17/0046* (2013.01); *A63C 17/015* (2013.01); *A63C 17/0093* (2013.01); *A63C 2203/20* (2013.01)

(58) Field of Classification Search
CPC . A63C 17/012; A63C 17/0046; A63C 17/015; A63C 2203/20; A63C 17/0093
See application file for complete search history.

(56) References Cited

U.S. PATENT DOCUMENTS 2,763,490 A * 9/1956 Crone ..... A63C 17/02 280/11.208
4,047,725 A * 9/1977 Pinchock ..... A63C 17/0046 280/11.28

(Continued)

OTHER PUBLICATIONS

Original S8 200nm Carving Trrucks—Original Skateboards from the internet https://originalskateboards.com/product/original-s8-200nm-carving-trucks/ dated Apr. 25, 2017, pp. 1-7.

(Continued)

*Primary Examiner* — Jacob B Meyer
(74) *Attorney, Agent, or Firm* — McCarter & English, LLP

(57) ABSTRACT

Exemplary embodiments are directed to a base plate for a skateboard that includes a body, and first and second pivot cups. The body includes a proximal end and a distal end. The first pivot cup extends from the body at or near the distal end. The second pivot cup is spaced from the first pivot cup and extends from the body at or near the proximal end. The second pivot cup defines an outer perimeter surface having an uninterrupted height. The second pivot cup includes an opening extending therethrough and surrounded by the outer perimeter surface of the second pivot cup. The second pivot cup includes one or more channels extending from the opening and through at least a portion of the second pivot cup. The one or more channels extend through at least the portion of the second pivot cup without extending through the outer perimeter surface.

20 Claims, 16 Drawing Sheets

(56) References Cited

U.S. PATENT DOCUMENTS 5,879,013 A * 3/1999 Shih ..... A63C 17/01 280/11.28
6,224,076 B1 * 5/2001 Kent ..... A63C 17/0046 280/11.28
6,315,304 B1 * 11/2001 Kirkland ..... A63C 17/01 280/11.28
6,315,312 B1 * 11/2001 Reyes ..... A63C 17/01 280/11.27
6,428,023 B2 * 8/2002 Reyes ..... A63C 17/01 280/11.27
6,443,471 B1 * 9/2002 Mullen ..... A63C 17/01 280/87.042
6,467,782 B1 * 10/2002 Smith ..... A63C 17/01 280/11.28
6,523,837 B2 * 2/2003 Kirkland ..... A63C 17/01 280/11.28
6,793,224 B2 * 9/2004 Stratton ..... A63C 17/01 280/87.041
6,932,362 B1 * 8/2005 Barrett ..... A63C 17/01 280/11.27
7,080,845 B2 * 7/2006 Inchley ..... A63C 17/0093 280/87.042
7,413,200 B2 * 8/2008 Horn ..... A63C 17/01 280/11.27
8,182,514 B2 * 5/2012 Gimbel ..... A61B 17/7005 606/257
8,292,311 B2 * 10/2012 De Las Casas .... A63C 17/0046 280/87.042
8,328,206 B2 * 12/2012 Williams, Jr. ..... A63C 17/0093 280/11.27
8,424,882 B2 * 4/2013 Visinski ..... A63C 17/012 280/11.27
8,579,300 B2 * 11/2013 Fraley ..... A63C 17/012 280/11.28
8,684,370 B2 * 4/2014 Baumann ..... A63C 17/0093 280/11.27
8,783,699 B2 * 7/2014 Gesmer ..... A63C 17/012 280/87.042
8,888,108 B1 * 11/2014 Beaty ..... A63C 17/012 280/11.27
8,985,602 B2 * 3/2015 Chan ..... B62K 3/002 280/87.041
9,095,765 B2 * 8/2015 Miller ..... A63C 17/02
9,144,730 B1 * 9/2015 Visinski ..... A63C 17/012
9,199,158 B2 * 12/2015 Docter ..... A63C 17/0093
9,289,676 B2 * 3/2016 Docter ..... A63C 17/0093
9,381,968 B2 * 7/2016 Chan ..... B62K 3/002
9,415,295 B2 * 8/2016 Braden ..... A63C 17/012
9,604,123 B2 * 3/2017 Tolman ..... A63C 17/012
2002/0011713 A1 * 1/2002 Kirkland ..... A63C 17/01 280/11.28
2002/0084602 A1 * 7/2002 Feng ..... A63C 17/02 280/11.223
2006/0097470 A1 * 5/2006 Chmelar ..... A63C 17/0093 280/87.042
2007/0164530 A1 * 7/2007 Horn ..... A63C 17/0093 280/87.042
2009/0105827 A1 * 4/2009 Gimbel ..... A61B 17/7005 623/17.16
2010/0327547 A1 * 12/2010 Wilson ..... A63C 17/012 280/87.042
2011/0148055 A1 * 6/2011 Visinski ..... A63C 17/012 280/11.27
2013/0308887 A1 * 11/2013 Gesmer ..... A63C 17/012 384/523
2014/0339884 A1 * 11/2014 Gesmer ..... A63C 17/012 301/5.7
2015/0130154 A1 * 5/2015 Docter ..... A63C 17/0093 280/124.114
2015/0130156 A1 * 5/2015 Docter ..... A63C 17/0093 280/124.114
2015/0145226 A1 * 5/2015 Tolman ..... A63C 17/012 280/87.042
2019/0054366 A1 * 2/2019 Sandusky ..... A63C 17/012

OTHER PUBLICATIONS

International Search Report based on co-pending PCT International Application No. PCT/US2018/46498, dated Oct. 29, 2018, 3 Pages.
Written Opinion based on co-pending PCT International Application No. PCT/US2018/46498, dated Oct. 29, 2018, 8 Pages.

* cited by examiner

SKATEBOARD BASE PLATE AND ASSOCIATED SYSTEMS

CROSS-REFERENCE TO RELATED APPLICATIONS

The present application claims the benefit of U.S. Provisional Patent Application No. 62/547,404, which was filed on Aug. 18, 2017, U.S. Provisional Patent Application No. 62/558,820, which was filed on Sep. 14, 2017, and U.S. Provisional Patent Application No. 62/616,857, which was filed on Jan. 12, 2018. The entire content of the foregoing provisional applications is incorporated herein by reference.

TECHNICAL FIELD

The present disclosure relates to skateboard base plate and associated systems and, in particular, to skateboard base plates with a stronger overall structure, elements and components for providing reliable restorative forces during turning and riding.

BACKGROUND

Skateboards generally include two trucks mounted to the bottom of the deck that allow for the skateboard to travel over various surfaces and provide the turning mechanism and restorative forces during turns. Particularly, trucks are the mechanisms that allow the deck to roll about its forward vector while all wheels remain in contact with the ground as the board and skater perform a turn. Traditional truck designs are many and varied, some of which rely on elastomer bushings while others rely on metallic compression springs to provide restorative forces which provide response to the rider and ultimately return the deck to a level position.

FIGS. 1-3 show a traditional spring-assisted skateboard truck 10 (e.g., Original S8 Carving Trucks, available at https://originalskateboards.com/product/original-s8-200 mm-carving-trucks/). Traditional trucks 10 are generally mounted to an extension riser block 12 from the bottom or top surface of the deck 14, and further may include an additional riser block 16 mounted between the truck 10 and the extension riser block 12 to provide clearance between the deck 14 and the wheels 18, 20. The riser block 16 provides clearance between the outside wheel edge and the bottom deck surface during turns such that there is no "wheel bite". Some wedge-shaped riser blocks 16 can be used to change the angle of the center of rotation of the truck mechanism.

The traditional spring-assisted truck 10 includes a base plate 22 with opposing pivot cups 24, 26. The truck 10 receives a hanger 28 and spring 30 within the space between the pivot cups 24, 26, and a kingpin 32 (e.g., bolt) is used to secure the hanger 28 and spring 30 to the base plate 22. The hanger 28 includes an axle 34 extending therethrough for rotatably mounting of the wheels 18, 20 to the hanger 28. As shown in FIGS. 2 and 3, the truck 10 includes a plastic wave cam 36 mounted within the pivot cup 24. During tuning of the truck 10, a hex wrench 40 is used to tighten the kingpin 32 into a locknut 38. Particularly, the pivot cup 24 includes a cutout 42 (e.g., locktab slot) at one or more places along the perimeter of the pivot cup 24 configured to receive a locking key 44 (e.g., a locktab). The nut 38 is positioned over the locking key 44 such that tightening the kingpin 32 guides the locking key 44 into the cutout 42 in the pivot cup 24. As shown in FIG. 3, the locking key 44 therefore extends through the perimeter of the pivot cup 24 through the cutout 42.

As shown in FIG. 2, tuning of traditional spring-assisted trucks 10 generally involves tightening the kingpin 32, thereby preloading the compression spring 30 until the wave cam 36 extends from the end of the pivot cup 24 by a predetermined distance 46 (e.g., approximately 1 mm). The traditional kingpin 32 generally includes a threaded end that receives the nut 38. The threads on the threaded end extend approximately 20 mm in length from the endpoint of the kingpin 32, allowing the nut 38 to be threaded onto the kingpin 32 up to a maximum of 20 mm from the endpoint of the kingpin 32. The desired predetermined distance 46 is located between the endpoint of the kingpin 32 and the maximum of 20 mm from the endpoint along the threads, resulting in an approximation of how far the nut 38 should be tightened onto the kingpin 32. Because tuning of the truck 10 is performed by approximation and the extended length of the threads on the kingpin 32 allow for the nut 38 to be tightened up to the 20 mm point, overtightening of the kingpin 32 such that the wave cam 36 does not extend from the end of the pivot cup 24 can occur, resulting in catastrophic loads on the truck 10, pivot cup 24 and/or wave cam 36 during normal use of the skateboard.

This approximation is tight enough for the wave cams 36 to be axially compressively preloaded by the spring 30 in such a way that as the deck rolls about its forward vector and the hanger 28 rotates to keep the wheels 18, 20 in contact with the ground, the wave cams 36 slide in opposite-handed directions, thereby compressing the restorative compression spring 30. If there is no preload and there is total travel in the spring 30, the plastic wave cams 36 are overly constrained by the leverage of the rider. In this condition, the excessive strains exceed the wave cam 36 ultimate yield strain, resulting in cracked or shattered wave cams 36. The broken wave cam 36 fragments can fall out of the pivot cup 24 (e.g., through the distal end of the pivot cup 24) leading to a dangerously unstable mechanism and perilous circumstances for the skateboard rider. In addition, increased structural pressure can result in, e.g., fracture 48 of the pivot cup 24 at a weak point created by the locktab slot or cutout 42 (see, e.g., FIG. 4), fracture 50 of the locking key 44 at the cutout 42 (see, e.g., FIG. 5), combinations thereof, or the like. Replacement of the fractured the base plate 22 or locking key 44 leads to a significant increase in maintenance costs for the skateboard.

Thus, a need exists for a spring-assisted skateboard truck assembly that eliminates structural weak points in the base plate to prevent structural failure of the pivot cup containing the wave cam, thereby increasing safety and reliability while reducing overall maintenance costs of the skateboard. Another need exists for a compressive spring having adequate total travel and safe travel which fits within the volume defined by the baseplate. A further need exists for a kingpin that provides for a maximum tightened position so as to prevent overtightening of the spring/wave came assembly. These and other needs are addressed by the skateboard base plates and associated systems of the present disclosure.

SUMMARY

The present disclosure is directed to a base plate for a skateboard. One object of the invention is that the base plate includes a body including a proximal end and a distal end. Another object of the invention is that the base plate includes a first pivot cup extending from the body at or near the distal end. Another object of the invention is that the base plate includes a second pivot cup spaced from the first pivot cup and extending from the body at or near the proximal end. The second pivot cup defines an outer perimeter surface having an uninterrupted height. The outer perimeter surface of the second pivot cup can define a substantially uniform height. Another object of the invention is that the second pivot cup includes an opening extending therethrough and completely surrounded by the outer perimeter surface of the second pivot cup.

The present disclosure is also directed to a base plate for a skateboard. One object of the invention is that the base plate includes a body including a proximal end and a distal end. Another object of the invention is that the base plate includes a first pivot cup extending from the body at or near the distal end. Another object of the invention is that the base plate includes a second pivot cup spaced from the first pivot cup and extending from the body at or near the proximal end. The second pivot cup defines an outer perimeter surface, and includes an opening extending therethrough and surrounded by the outer perimeter surface of the second pivot cup.

The present disclosure is further directed to a truck for a skateboard. One object of the invention is that the truck includes a base plate. The base plate includes a body including a proximal end and a distal end, a first pivot cup extending from the body at or near the distal end, and a second pivot cup spaced from the first pivot cup and extending from the body at or near the proximal end. The second pivot cup defines an outer perimeter surface having an uninterrupted height. Another object of the invention is that the truck includes a hanger movably mounted between the first and second pivot cups of the base plate.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed skateboard base plates and associated systems, reference is made to the accompanying figures, wherein.

DESCRIPTION OF EXEMPLARY EMBODIMENTS

In accordance with embodiments of the present disclosure, exemplary base plates and truck assemblies are provided to allow for greater structural strength during use in skateboard or longboard applications. The base plate includes a pivot cup in which a wave cam is placed. The pivot cup defines a substantially uninterrupted outer perimeter surface such that the locking key (e.g., locktab) and wave came are surrounded by the outer perimeter surface. The lack of cutouts (e.g., locktab slots) in the outer perimeter surface of the pivot cup reduces structurally weak points in the pivot cup and prevents structural failure of the pivot cup curing overtightening of the kingpin.

Figure 1:
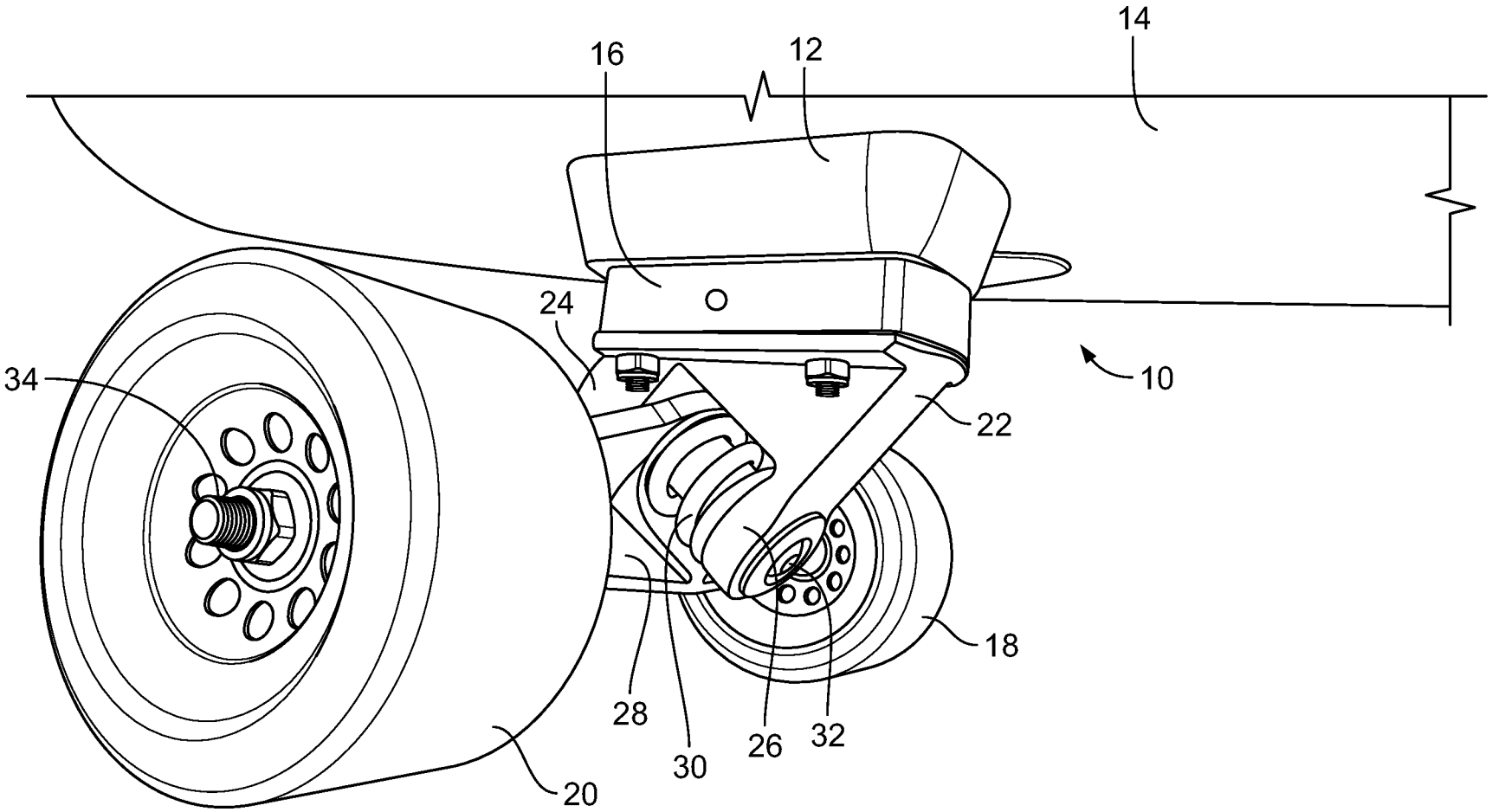
FIG. 1 (Prior Art)
FIG. 1 is a perspective view of a traditional skateboard truck mounted to the bottom of a deck.
Figure 2:
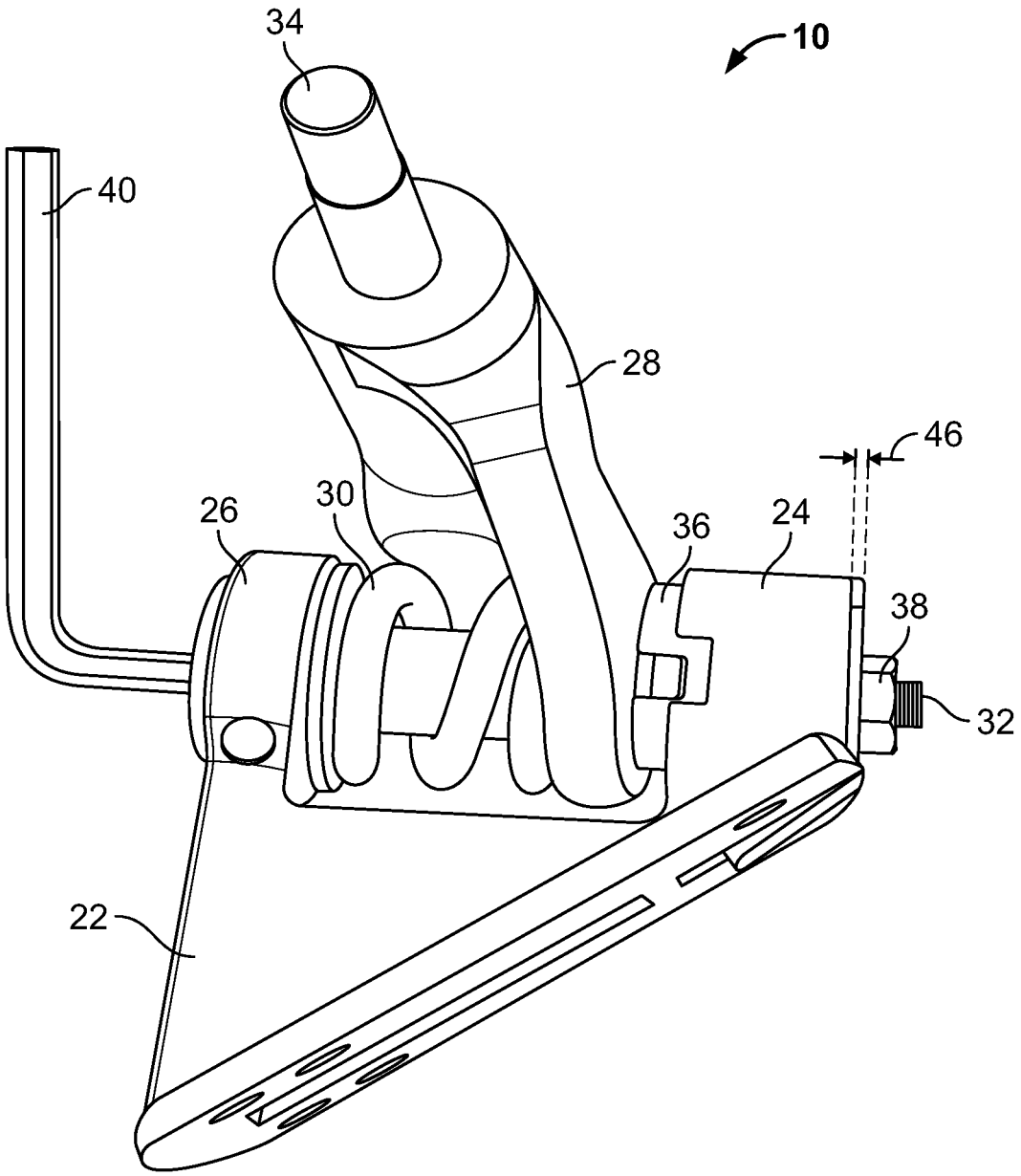
FIG. 2 (Prior Art)
FIG. 2 is a side view of a traditional skateboard truck including a hex wrench for tuning the skateboard truck.
Figure 3:
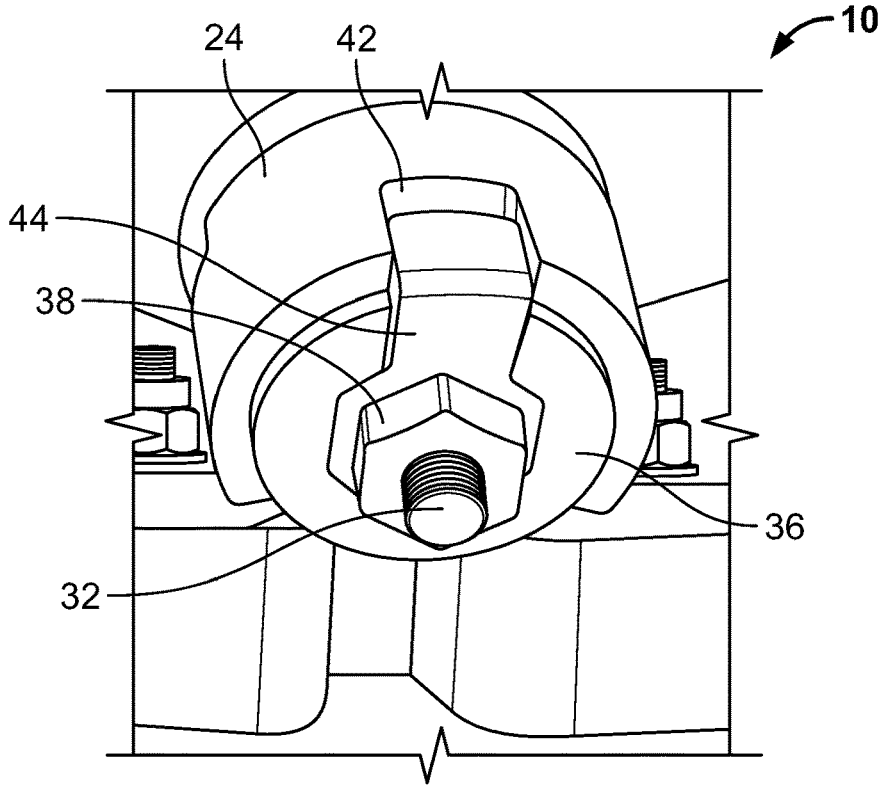
FIG. 3 (Prior Art)
FIG. 3 is a detailed view of a locking key and wave cam of a traditional skateboard truck.
Figure 4:
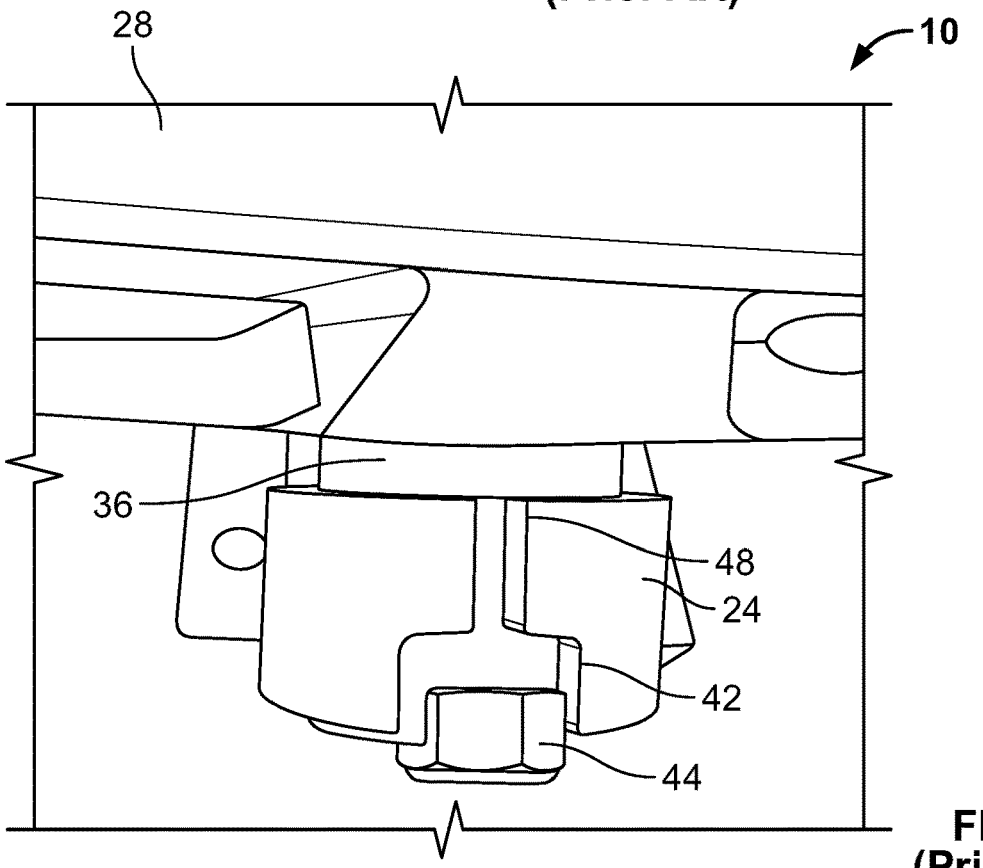
FIG. 4 (Prior Art)
FIG. 4 is a detailed view of a structural failure of a traditional skateboard truck.
Figure 5:
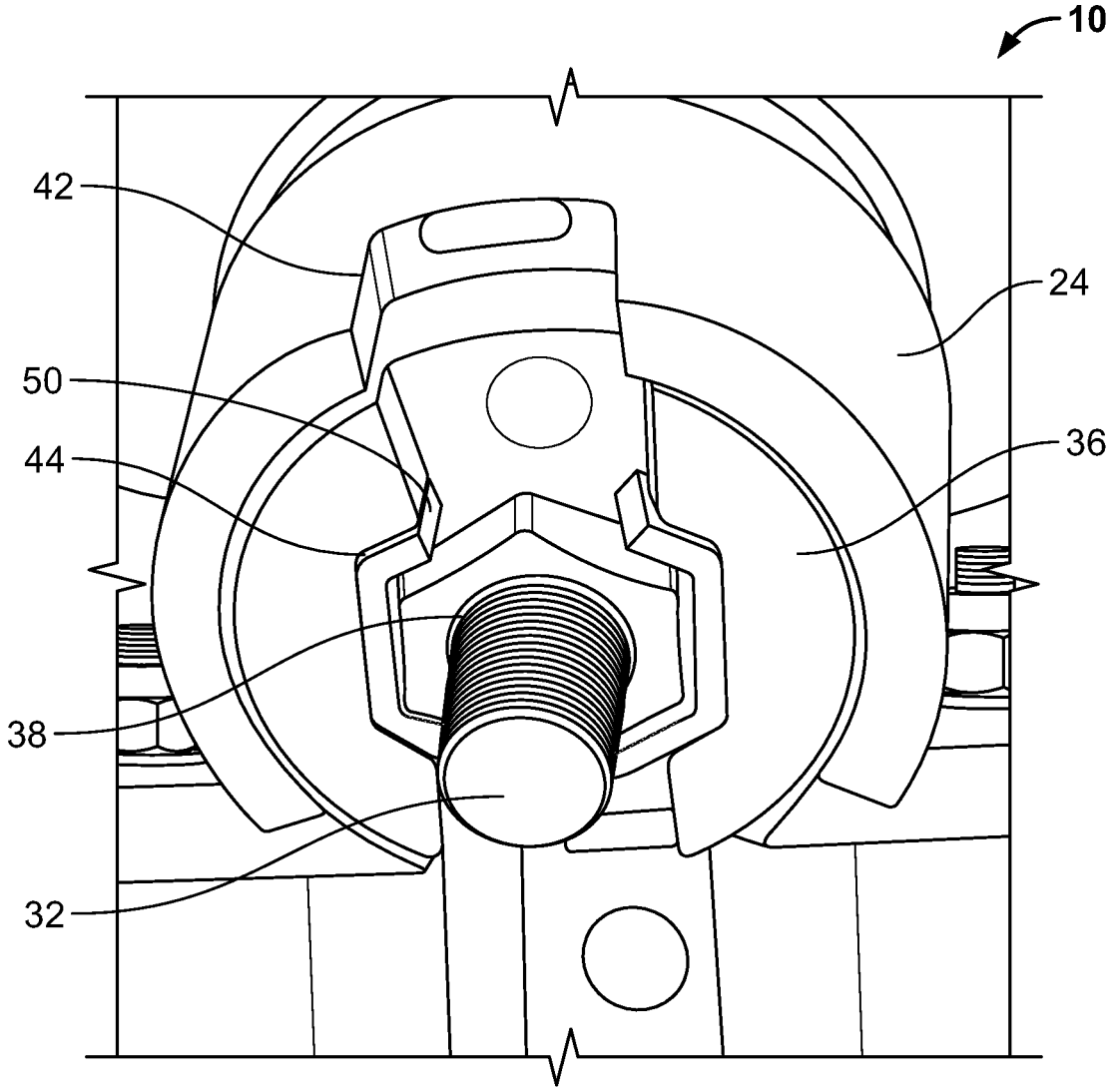
FIG. 5 (Prior Art)
FIG. 5 is a detailed view of a structural failure of a locking key of a traditional skateboard truck.
Figure 6:
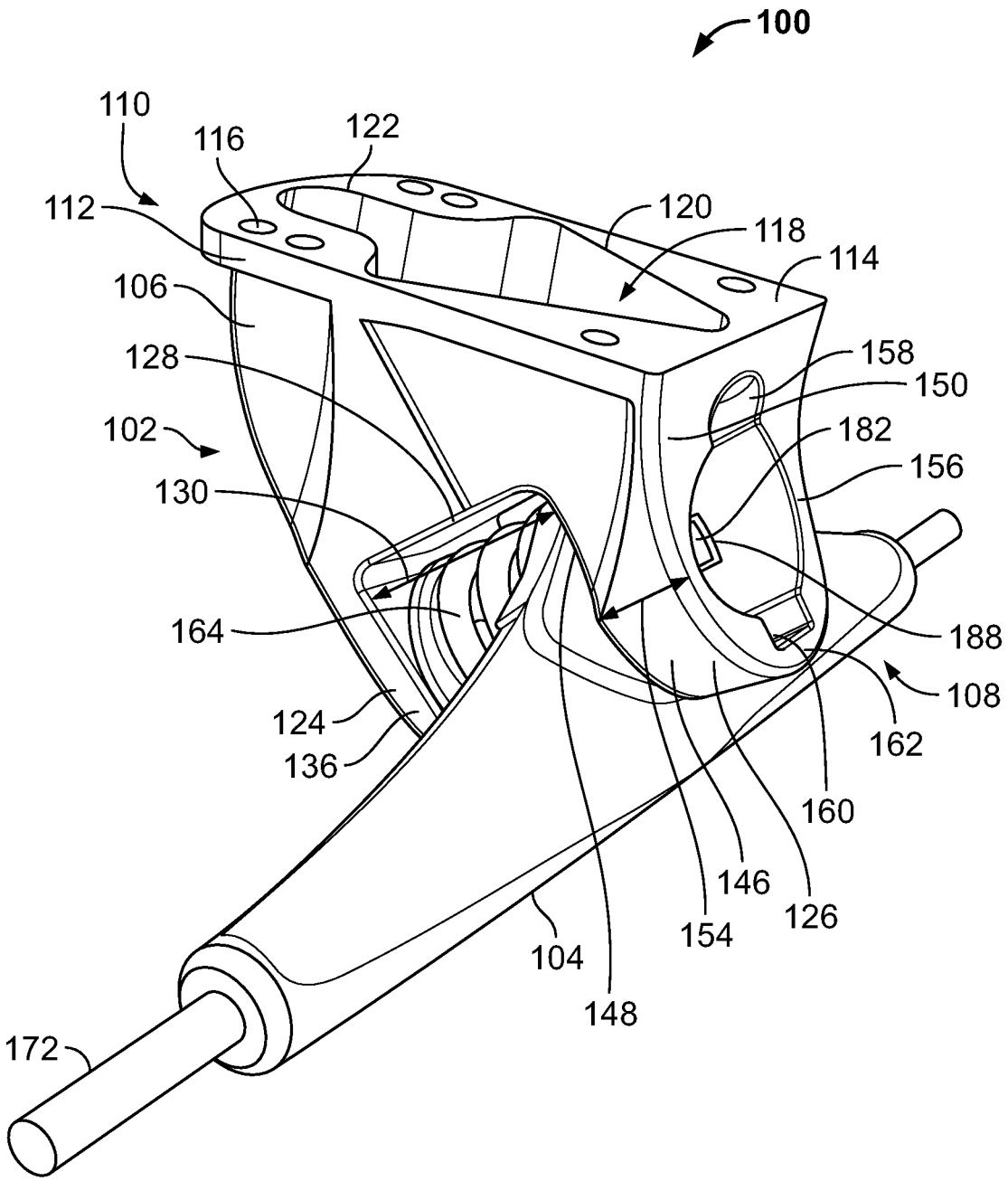
FIG. 6 is a rear, perspective view of an exemplary skateboard truck assembly according to the present disclosure.
Figure 7:
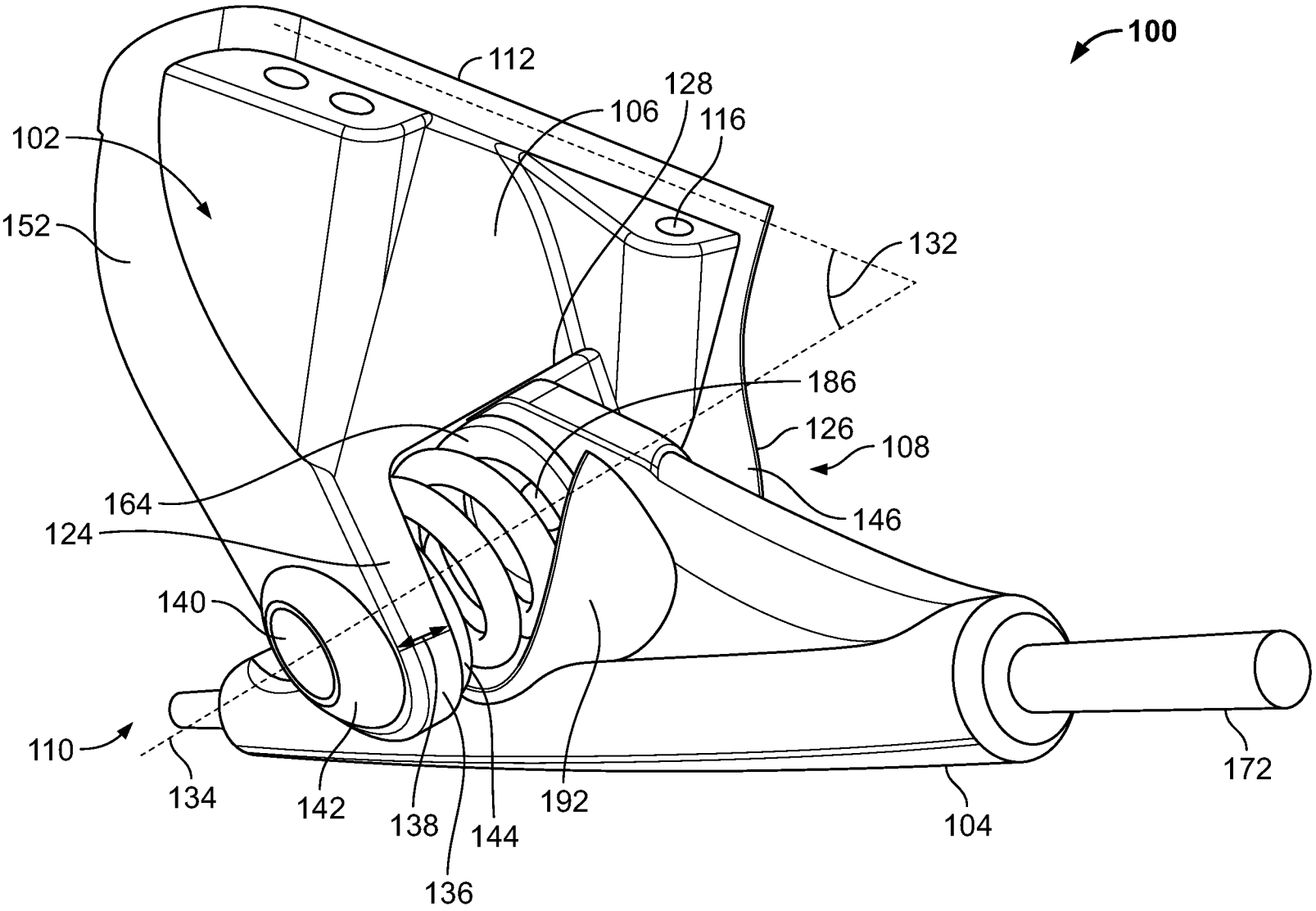
FIG. 7 is a front, perspective view of an exemplary skateboard truck assembly according to the present disclosure.

FIGS. 6 and 7 are rear and front perspective views of an exemplary spring-assisted truck assembly 100 (hereinafter "assembly 100") in accordance with embodiments of the present disclosure. The assembly 100 generally includes a base plate 102 and a hanger 104 movably mounted to the base plate 102. Although not illustrated, it should be understood that the assembly 100 can include a kingpin, wave cam, locking key, and nut (e.g., locknut) similar to those shown in FIGS. 1-5. The assembly 100 can also include a large inner diameter washer, a small inner diameter washer, and a spring 30. In some embodiments, rather than a kingpin, the assembly 100 can include a bolt with a cotter pin, a bolt with a retaining C-ring, or the like. The base plate 102 and/or the hanger 104 can be fabricated from, e.g., cast aluminum, steel, polymer, fiber reinforced polymer composite, combinations thereof, or the like. The base plate 102 includes a body 106 defining a proximal end 108 and a distal end 110. The base plate 102 includes a base 112 that defines the top section of the base plate 102. The base 112 can define a substantially rectangular configuration, with a substantially planar top surface 114.

The base 112 includes multiple openings 116 extending therethrough and configured to receive fasteners (e.g., bolts or screws) for attachment of the base plate 102 to the bottom surface of the deck of a skateboard. In some embodiments, the proximal end 108 of the base plate 102 can include a single pair of openings 116 on opposing sides of the base 112, and the distal end 110 of the base plate 102 can include two pairs of openings 116 on opposing sides of the base 112. In some embodiments, the base plate 102 can include a cavity 118 extending partially into the body 106 from the top surface 114, resulting in a partially hollow structure of the body 106. The cavity 118 can reduce the overall weight of the base plate 102 while maintaining the structural integrity of the base plate 102. In some embodiments, the cavity 118 can define an arrow-shaped configuration, with a substantially triangular section 120 at the proximal end 108 and a narrower elongated section 122 at the distal end 110.

The base plate 102 includes a first pivot cup 124 extending from the body 106 and away from the base 112 at or near the distal end 110. The base plate 102 further includes a second pivot cup 126 extending from the body 106 and away from the base 112 at or near the proximal end 108. The base plate 102 includes a channel or cutout 128 (e.g., locktab slot) formed in the body 106 and extending laterally between the first and second pivot cups 124, 126. The first and second pivot cups 124, 126 are therefore spaced from each other and separated by the cutout 128. The cutout 128 separates the first and second pivot cups 124, 126 by a distance 130. The distance 130 of the cutout 128 can be selected such that additional components of the assembly 100 can be received between the first and second pivot cups 124, 126. The first and second pivot cups 124, 126 are also spaced or elevated from the base 112 by a vertical distance such that the traditional riser block 16 is no longer necessary and instead is built directly into the structure of the base plate 102, resulting in a structurally stronger component.

The first and second pivot cups 124, 126 can be tilted relative to the plane defined by the base 112 by an angle 132 as measured from a central longitudinal axis 134 extending through both the first and second pivot cups 124, 126 (see, e.g., FIG. 7). In some embodiments, the angle 132 can be, e.g., approximately 25 degrees, approximately 26 degrees, approximately 27 degrees, approximately 28 degrees, approximately 29 degrees, approximately 30 degrees, approximately 31 degrees, approximately 32 degrees, approximately 33 degrees, approximately 34 degrees, approximately 35 degrees, approximately 36 degrees, approximately 37 degrees, approximately 38 degrees, approximately 39 degrees, approximately 40 degrees, approximately 41 degrees, approximately 42 degrees, approximately 43 degrees, approximately 44 degrees, approximately 45 degrees, approximately 46 degrees, approximately 47 degrees, approximately 48 degrees, approximately 49 degrees, approximately 50 degrees, approximately 51 degrees, approximately 52 degrees, approximately 53 degrees, approximately 54 degrees, approximately 55 degrees, or the like. In some embodiments, the angle 132 can be in a range of, e.g., approximately 25-55 degrees, approximately 35-55 degrees, approximately 45-55 degrees, or the like. The tilted configuration of the first and second pivot cups 124, 126 results in the first pivot cup 124 being disposed further from the base 112 than the second pivot cup 126.

The first pivot cup 124 includes an outer perimeter surface 136 that defines a substantially U-shaped configuration. In some embodiments, the outer perimeter surface 136 can extend substantially linearly from the body 106. The thickness or height 138 of the outer perimeter surface 136 as it extends around the first pivot cup 124 from either side of the body 106 can be dimensioned substantially uniformly. The outer perimeter surface 136 also defines a surface (and height 138) that is uninterrupted. As used herein, an uninterrupted surface can be a surface free of cutouts or openings.

The first pivot cup 124 includes an opening 140 extending therethrough along the central longitudinal axis 134. The opening 140 connects the distal end 110 of the base plate 102 with the interior of the cutout 128. In some embodiments, the opposing side walls 142, 144 of the first pivot cup 124 (e.g., walls on opposing sides of the outer perimeter surface 136) can be outwardly curved to increase the overall thickness of the first pivot cup 124 around the opening 140 for improved structural stability.

The second pivot cup 126 includes an outer perimeter surface 146 that defines a substantially U-shaped configuration. In some embodiments, the inner surface 148 of the second pivot cup 126 (e.g., the surface facing the first pivot cup 124) can be substantially parallel to the inner surface of the first pivot cup 124, and the outer surface 150 of the second pivot cup 126 can be curved inwardly in a concave manner. The outer surface 150 can therefore curve relative to and away from the base 112. In some embodiments, the curvature of the outer surface 150 can be substantially complementary to the curvature of the distal surface 152 of the body 106. In some embodiments, both the inner and outer surfaces 148, 150 can extend substantially linearly from the body 106 such that the inner and outer surfaces 148, 150 are both substantially parallel to the inner and/or outer surfaces of the first pivot cup 124.

The thickness or height 154 of the outer perimeter surface 146 as it extends around the second pivot cup 126 from either side of the body 106 can be dimensioned substantially uniformly. The outer perimeter surface 146 also defines a surface (and height 154) that is uninterrupted by cutouts or openings. The outer perimeter surface 146 therefore forms a substantially uniform structure around the perimeter of second pivot cup 126. The second pivot cup 126 includes an opening 156 extending therethrough along the central longitudinal axis 134. The outer perimeter surface 146 extends around and completely surrounds the opening 156. The opening 156 can be configured and dimensioned to at least partially receive therein a wave cam (e.g., wave cam 36 of FIGS. 1-5). Thus, although a wave cam is not illustrated, it should be understood that wave cam 36 (or similar) can be used with the assembly 100. In some embodiments, the wave cam can be fabricated from, e.g., a thermoplastic polymer, nylon, nylon 6.6, polycarbonate, or the like.

The second pivot cup 126 includes one or more channels 158, 160 formed therein and extending radially from the opening 156. The channels 158, 160 extend substantially parallel to the central longitudinal axis 134 and extend through at least a portion of the thickness or height 154 of the second pivot cup 126. In some embodiments, the channels 158, 160 can define a substantially square or rectangular cross-section. The channels 158, 160 can be configured and dimensioned to receive at least partially therein a locking key (e.g., locking key 44 of FIGS. 1-5). Thus, although a locking key is not illustrated, it should be understood that locking key 44 (or similar) can be used with the assembly 100.

In some embodiments, the channels 158, 160 can be radially spaced by approximately 180 degrees (e.g., on opposing sides of the opening 156). The channels 158, 160 extend through at least a partial distance of the height 154 without extending through the outer perimeter surface 146. In particular, the outer perimeter surface 146 completely surrounds both the opening 156 and the channels 158, 160. For example, a thickness 162 remains between the outer perimeter surface 146 and the nearest channel 160. In some embodiments, the thickness 162 can be, e.g., approximately 3 mm, approximately 4 mm, approximately 5 mm, approximately 6 mm, or the like. In some embodiments, the thickness 162 can be in the range of, e.g., approximately 3-6 mm, approximately 4-5 mm, or the like.

The uniform height 154 of the outer perimeter surface 146 ensures that the opening 156 and channels 158, 160 are surrounded by a uniform structure of the second pivot cup 126, resulting in an improved structural stability of the base plate 102. In particular, rather than including a cutout that extends through the outer perimeter surface 146 (e.g., cutout 42 of FIG. 4 that forms a weak point in the structure of the pivot cup 24), the exemplary second pivot cup 126 maintains a uniform and strong structure around the entire perimeter of the second pivot cup 126.

Thus, even if a kingpin (e.g., kingpin 32 of FIG. 3) is overtightened against the wave cam disposed within the opening 156 of the second pivot cup 126, the outer perimeter surface 146 maintains structurally stable and does not fracture. If increased forces are placed on the assembly 100 after overtightening of the kingpin, the forces affect the weakest link of the assembly (e.g., the plastic wave cam) and may result in fracture of the wave cam. However, the wave cam is a plastic component having a low replacement value. The maintenance fees associated with replacement of the wave cam are therefore significantly lower than replacement of the entire base plate (as is needed with traditional base plates). The improved structural stability of the base plate 102 provides for a more cost-effective maintenance of the assembly 100. In addition, the uniform structure of the second pivot cup 126 provides a safer enclosure of the wave cam if the wave cam fractures during use. In particular, the uniform outer perimeter surface 146 maintains the wave cam within the second pivot cup 126 and prevents fractured pieces of the wave cam from falling out of the second pivot cup 126 and creating a potentially dangerous situation for the rider.

Still with reference to FIGS. 6 and 7, the assembly 100 includes a spring 164 disposed within the cutout 128 between the first and second pivot cups 124, 126. In some embodiments, rather than a spring 164, the assembly 100 can include an elastomer with a high resilience, e.g., cast polyurethane, or the like. The spring 164 can be disposed at one end against the inner surface of the first pivot cup 124 and against a surface of the hanger 104 at an opposing end. The spring 164 therefore provides a damping effect to the hanger 104 as the hanger 104 pivots and moves relative to the base plate 102. Springs 164 of different spring constants can be used to vary the amount of support provided by the spring 164. In some embodiments, closed and ground springs 164 can be used with spring constants of approximately 1,000 lb/in, approximately 1,100 lb/in, approximately 1,200 lb/in, approximately 1,300 lb/in, approximately 1400 lb/in, approximately 1,500 lb/in, approximately 1,600 lb/in, approximately 1,700 lb/in, approximately 1,800 lb/in, approximately 1,900 lb/in, approximately 2,000 lb/in, approximately 2,100 lb/in, approximately 2,200 lb/in, approximately 2,300 lb/in, approximately 2,400 lb/in, approximately 2,500 lb/in, or the like. In some embodiments, the spring constants can be in a range of, e.g., approximately 1,000 lb/in to 2,500 lb/in, approximately 1,250 lb/in to 2,000 lb/in, approximately 1,200 lb/in to 1,800 lb/in, or the like.

Figure 8:
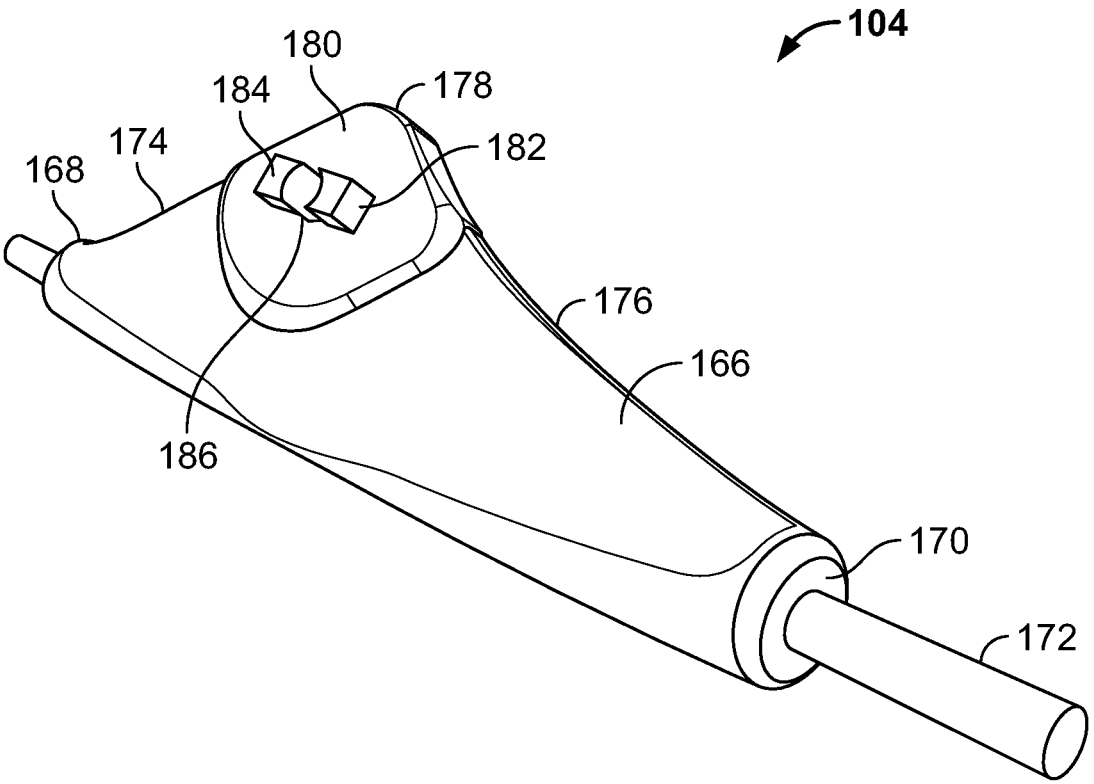
FIG. 8 is a rear, perspective view of a hanger of an exemplary skateboard truck assembly according to the present disclosure.
Figure 9:
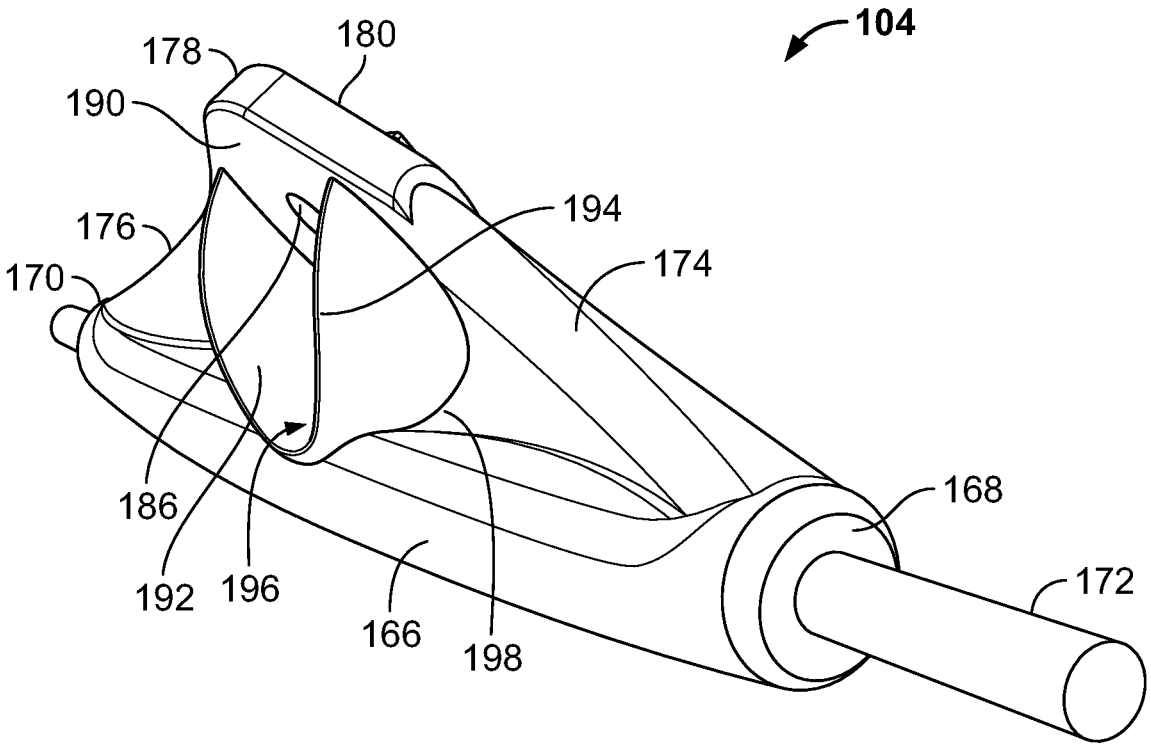
FIG. 9 is a front, perspective view of a hanger of an exemplary skateboard truck assembly according to the present disclosure.

With reference to FIGS. 8 and 9, rear and front perspective views of the hanger 104 are provided. The hanger 104 generally includes an elongated body 166 defining substantially flat opposing ends 168, 170. An axle 172 passes through the body 166 and extends from the opposing ends 168, 170 such that wheels (e.g., wheels 18, 20 of FIG. 1) can be rotatably mounted to the axle 172. The hanger 104 includes walls 174, 176 that extend in a curved manner from the body 166 towards a mounting section 178.

One side of the mounting section 178 can define a substantially flat mounting surface 180. The mounting surface 180 can include two protrusions 182, 184 extending outwardly from the mounting surface 180. The protrusions 182, 184 can be disposed on opposing sides of and adjacent to an opening 186 extending through the mounting section 178. The opening 186 can be configured and dimensioned to receive the kingpin therethrough. In some embodiments, the inner surface 148 of the second pivot cup 126 of the base plate 102 can include cutouts 188 formed around the opening 156 configured and dimensioned to receive the protrusions 182, 184 (see, e.g., FIG. 6). The cutouts 188 are formed such that the outer perimeter surface 146 maintains a uniform structure and surrounds the cutouts 188. The protrusions 182, 184 can therefore be mated with the cutouts 188 in the base plate 102 to align the hanger 104 with the base plate 102 during assembly.

The opposing side of the mounting section 178 includes a substantially flat surface 190 with a curved wall 192 extending from the surface 190. The curved wall 192 forms an opening 194 at one end leading into an inner cavity 196 configured and dimensioned to receive one end of the spring 164. The walls 198 of the inner cavity 196 taper and reduce in volume approaching the body 166. Thus, during assembly, one of the springs 164 can be inserted into the inner cavity 196 of the hanger 104, and the hanger 104 can be aligned and mated with the inner surface 148 of the second pivot cup 126 of the base plate 104.

A wave cam can be inserted into the opening 156 of the second pivot cup 126 (to sit against the mounting surface 180), and a locking key and nut can be engaged with the wave cam. A kingpin can be inserted through the opening 140 of the first pivot cup 124, the spring 164, the hanger 104, the second pivot cup 126, the wave cam, and the locking key, and the nut can be used to tighten the assembly 100. The kingpin and nut therefore couple the components of the assembly 100 together, while along the hanger 104 to pivot about the kingpin.

Figure 10:
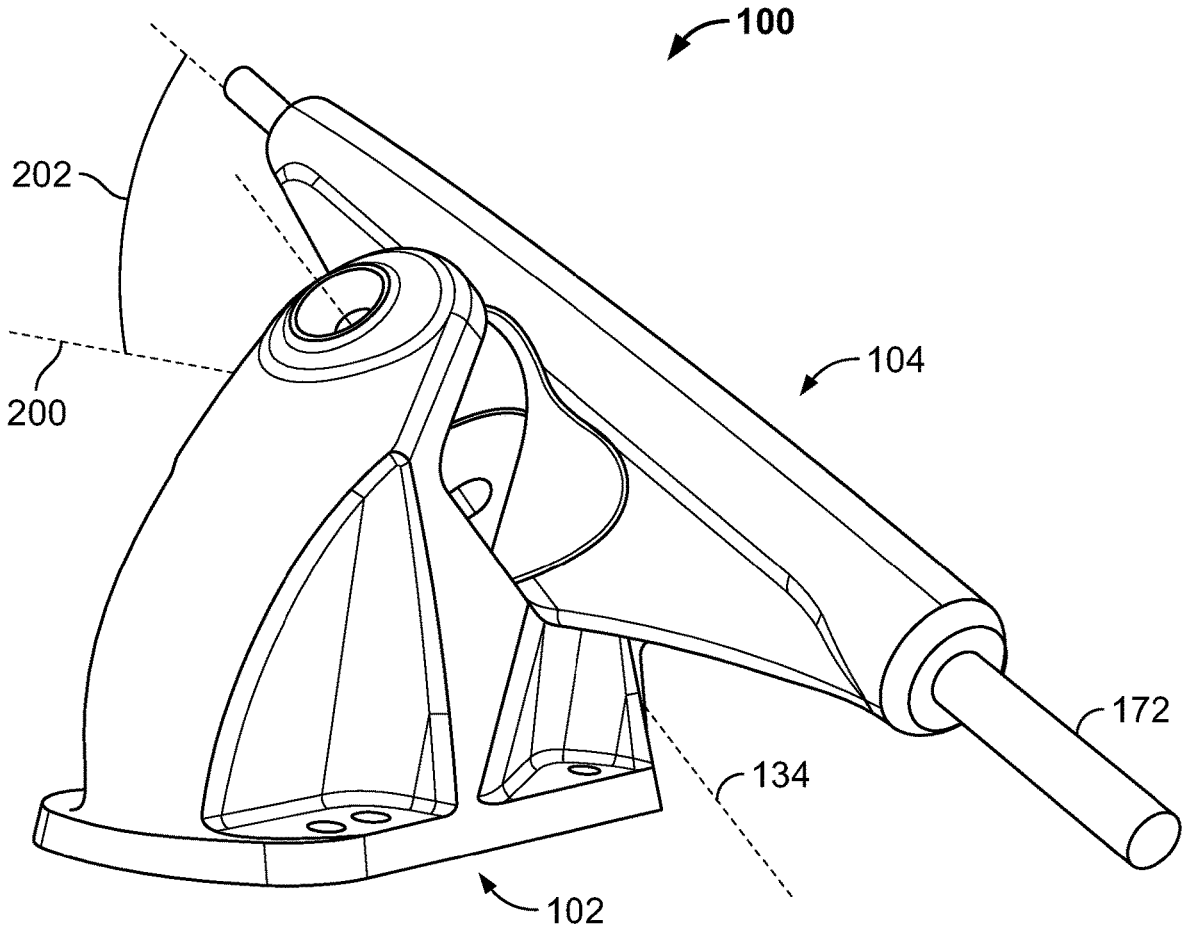
FIG. 10 is a front, perspective view of an exemplary skateboard truck assembly according to the present disclosure, including a hanger pivoted relative to a base plate.

FIG. 10 shows a perspective view of the assembly 100 with the hanger 104 pivoted relative to the base plate 102. In particular, when the hanger 104 is in the normal or unpivoted position, the axle 172 extends laterally on opposing sides of the base plate 102 along an axis 200. During use, the hanger 104 can pivot along the kingpin relative to the base plate 102 by an angle 202 measured from the axis 200 in both directions (e.g., above and below the axis 200 depending on the direction of pivoting). In some embodiments, the angle 202 can be, e.g., approximately 25 degrees, approximately 26 degrees, approximately 27 degrees, approximately 28 degrees, approximately 29 degrees, approximately 30 degrees, or the like. In some embodiments, the angle 202 can be in a range of, e.g., approximately 25-30 degrees, approximately 26-29 degrees, approximately 27-28 degrees, or the like.

Figure 11:
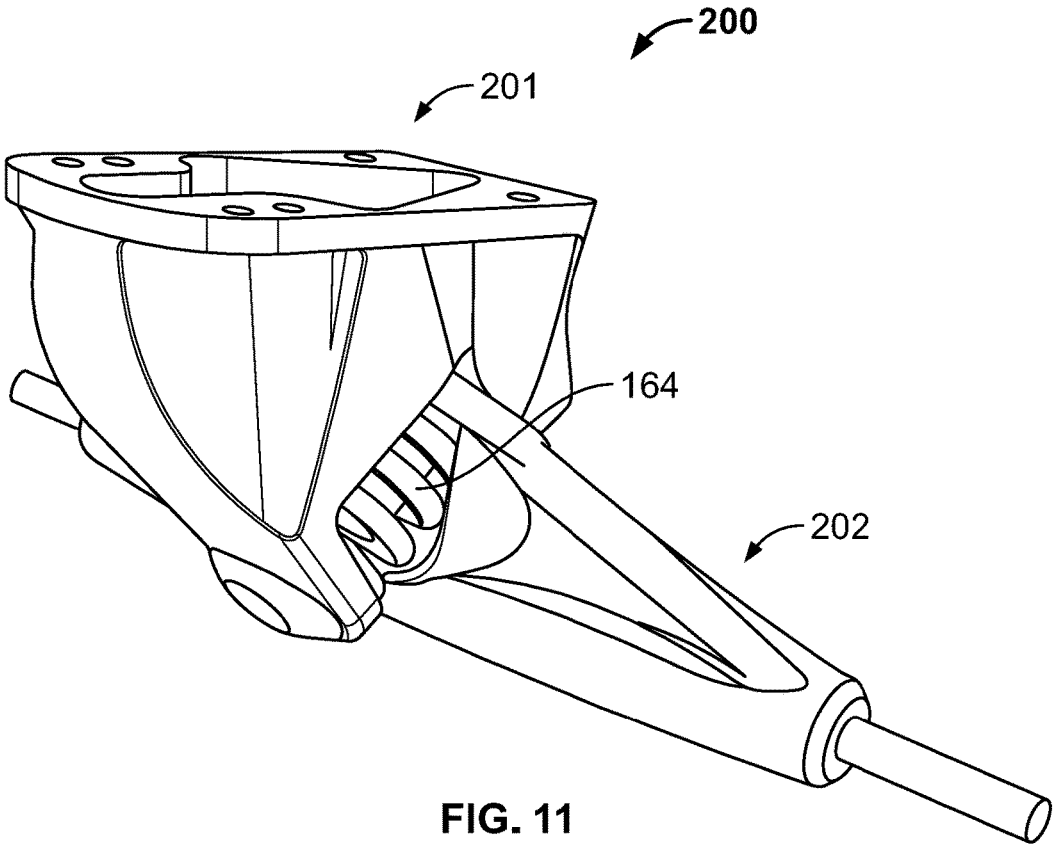
FIG. 11 is a right, perspective view of an exemplary skateboard truck assembly according to the present disclosure.
Figure 12:
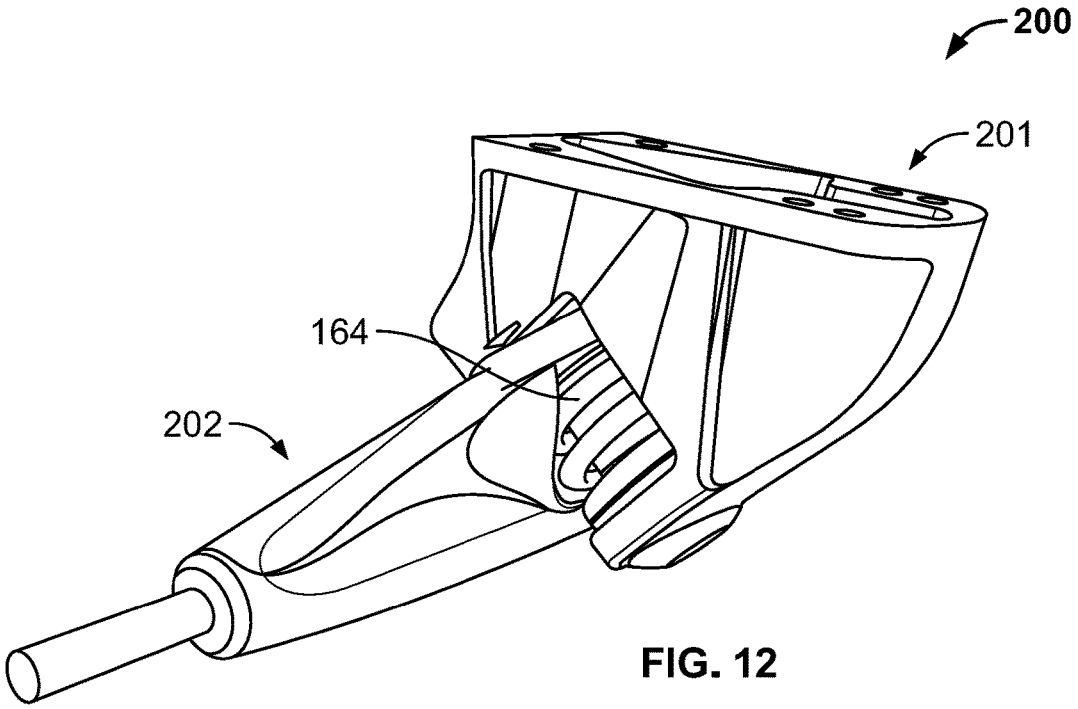
FIG. 12 is a left, perspective view of an exemplary skateboard truck assembly according to the present disclosure.
Figure 13:
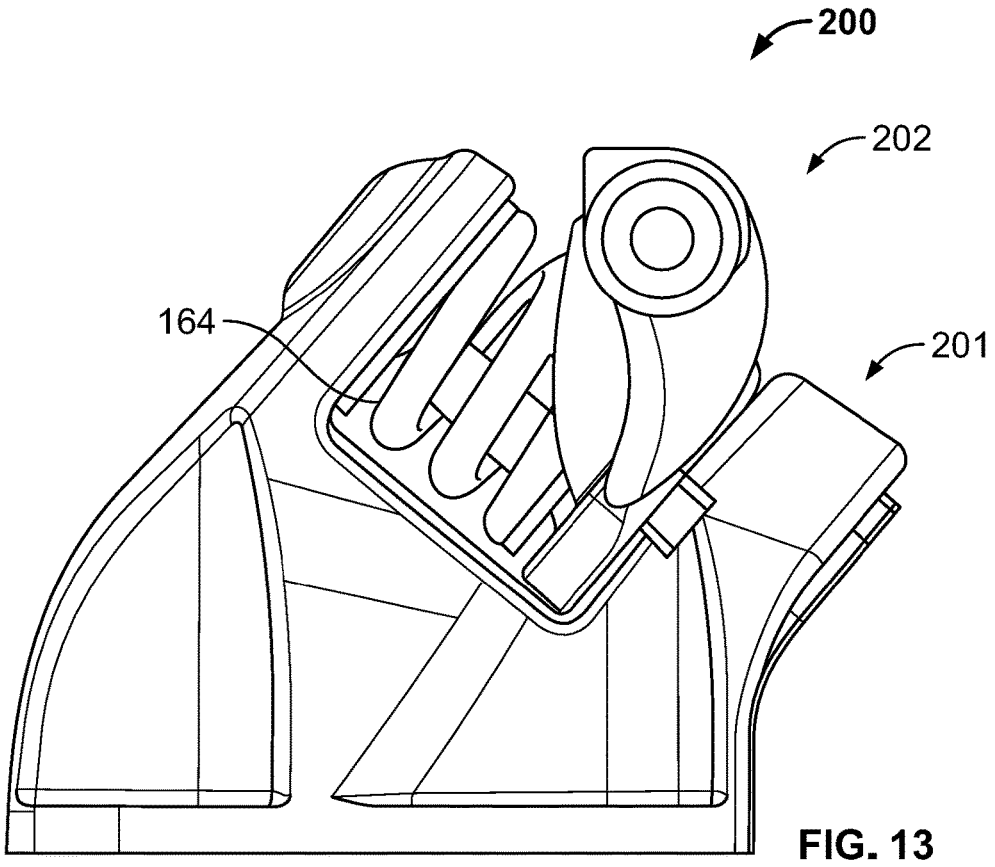
FIG. 13 is a side view of an exemplary skateboard truck assembly according to the present disclosure.
Figure 14:
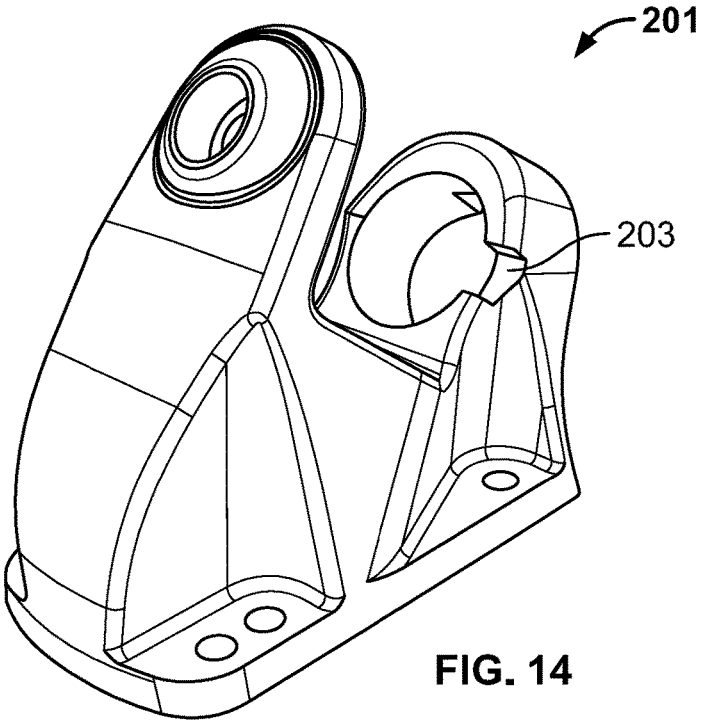
FIG. 14 is a rear, perspective view of a base plate of an exemplary skateboard truck assembly according to the present disclosure.
Figure 15:
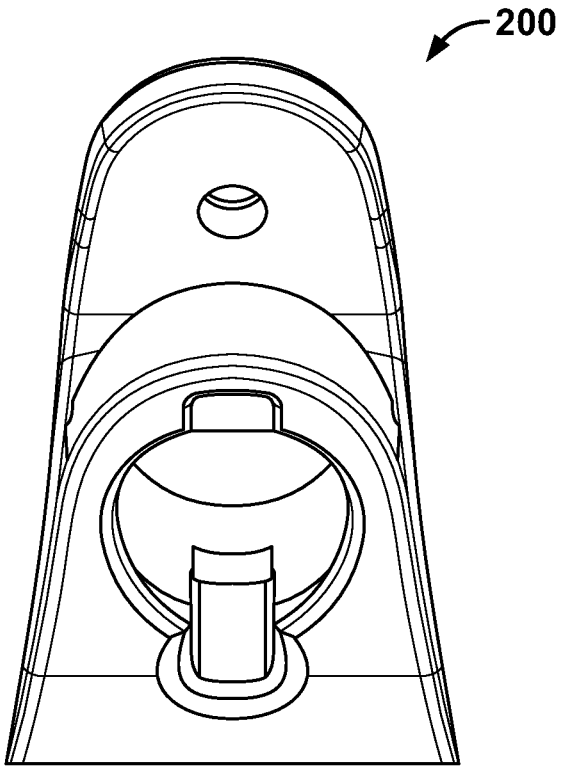
FIG. 15 is a rear view of a base plate of an exemplary skateboard truck assembly according to the present disclosure.
Figure 16:
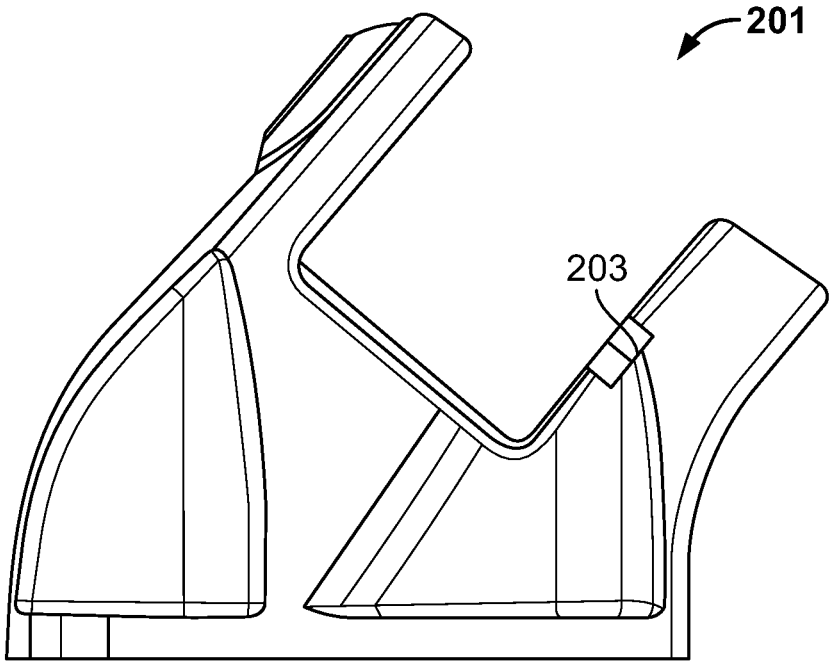
FIG. 16 is a side view of a base plate of an exemplary skateboard truck assembly according to the present disclosure.
Figure 17:
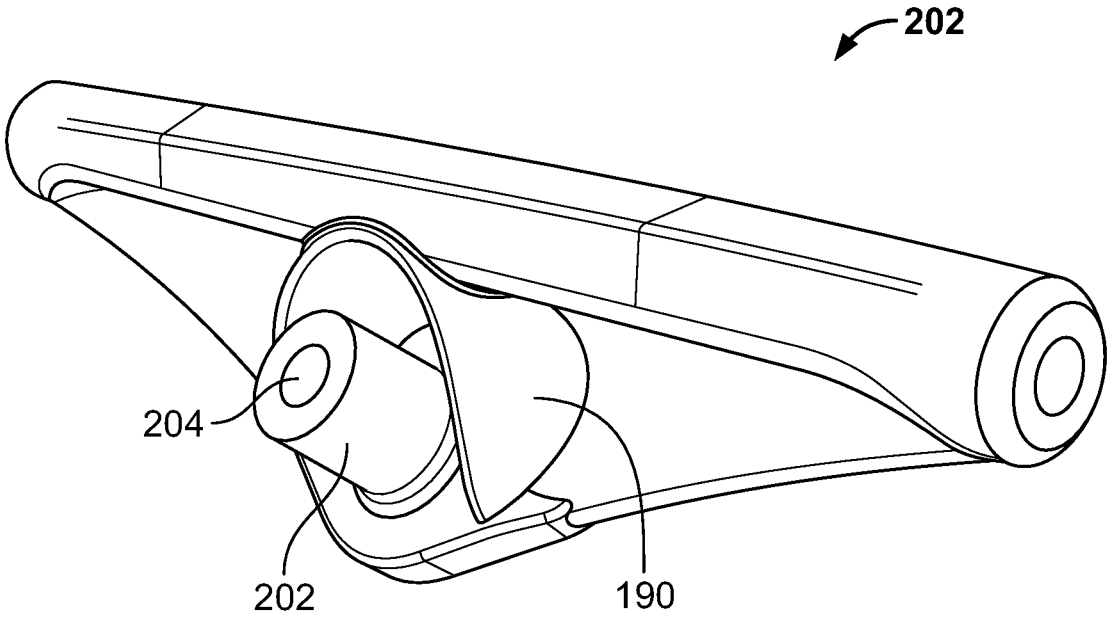
FIG. 17 is a rear, perspective view of a hanger of an exemplary skateboard truck assembly according to the present disclosure.
Figure 18:
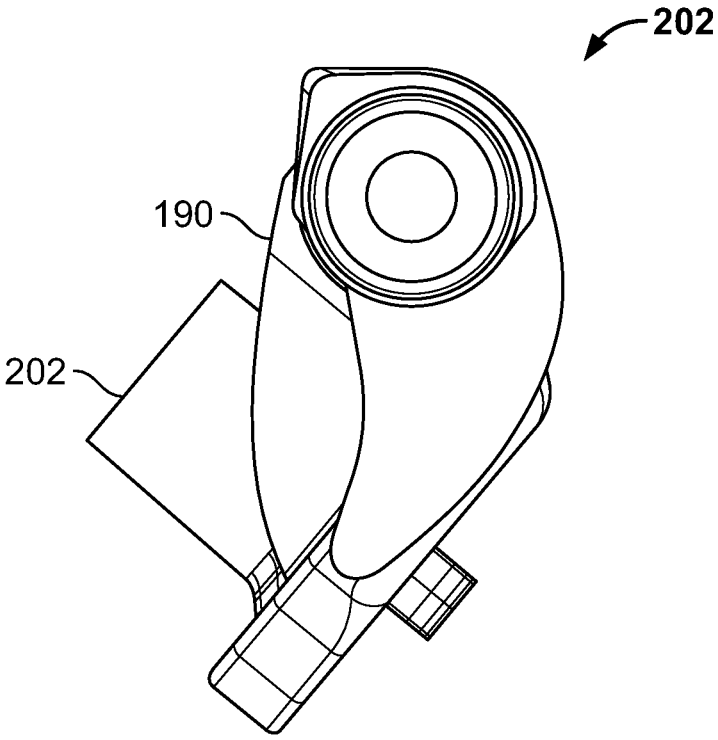
FIG. 18 is a side view of a hanger of an exemplary skateboard truck assembly according to the present disclosure.

FIGS. 11-18 show various views of an exemplary spring-assisted truck assembly 200 (hereinafter "assembly 200") in accordance with embodiments of the present disclosure. The assembly 200 can be substantially similar in structure and function to the assembly 100, except for the distinctions noted herein. In particular, the base plate 201 can be substantially similar in structure and function to the base plate 102, except for a cutout 203 formed on the inner surface 148 of the second pivot cup 126. The hanger 200 can be substantially similar in structure and function to the hanger 104, except that in addition to the curved wall 192, the hanger 200 can include a substantially cylindrical extension 202 protruding from the surface 190 within the confines of the curved wall 192. The opening 204 extends through the extension 202 and the surface 190. As shown in FIGS. 11-13, during assembly, the spring 164 fits over the extension 202, with the extension 202 preventing the spring 164 from lateral movement.

Figure 19:
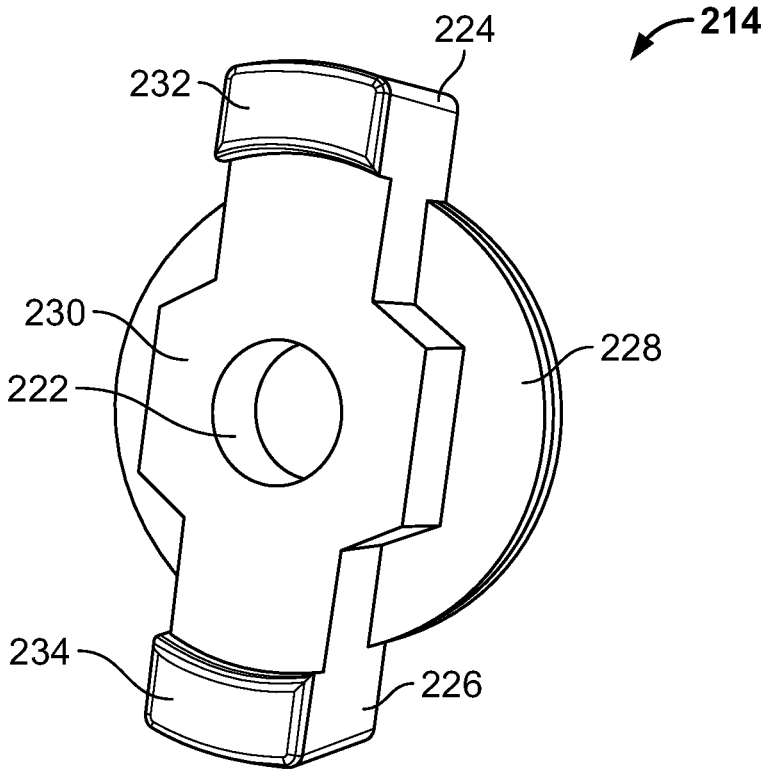
FIG. 19 is a rear, perspective view of a locking key of an exemplary skateboard truck assembly according to the present disclosure.
Figure 20:
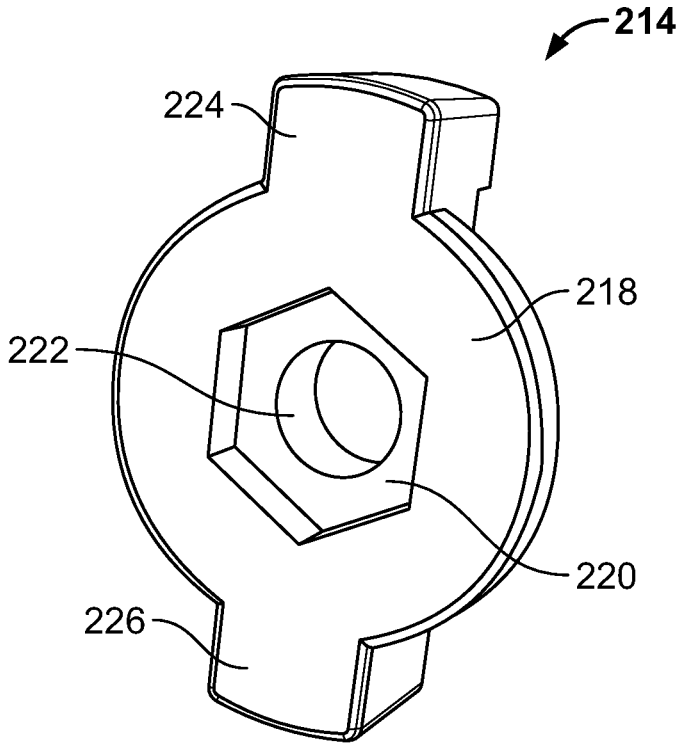
FIG. 20 is a front, perspective view of a locking key of an exemplary skateboard truck assembly according to the present disclosure.

FIGS. 19 and 20 show rear and front perspective views of an exemplary locking key 214 included in the assembly 200. In some embodiments, one side 218 (e.g., a top or outer side) of the locking key 214 can be substantially flat or planar with a central partial cutout or depression 220 configured to partially receive a nut 212. In some embodiments, the cutout or depression 220 can be a hexagonal shape such that the nut 212 fits within the cutout or depression 220 and prevents the nut 212 from rotating during tightening of the kingpin 210. The locking key 214 includes a central opening 222 passing therethrough configured to receive the kingpin 210. The locking key 214 includes two radial extensions or flanges 224, 226 extending outwardly from the circumference of the locking key 214 on opposing sides of the locking key 214. The opposing side 228 (e.g., a bottom or inner side) of the locking key 214 includes planar outer surfaces and a central protrusion 230 that extends away from the planar surfaces. The central protrusion 230 also extends from the flanges 224, 226. In some embodiments, the flanges 224, 226 include sections 232, 234 that protrude beyond the elevation of the central protrusion 230. In some embodiments, the surface of the wave cam configured to mate with the locking key 214 can include a cutout complementary to the central protrusion 230 and sections 232, 234 such that an interference fit is formed between the locking key 214 and wave cam. Such interference fit ensures a tight connection between the locking key 214 and wave cam, and prevents inadvertent disassembly or rotation of the locking key 214 relative to the wave cam.

Figure 21:
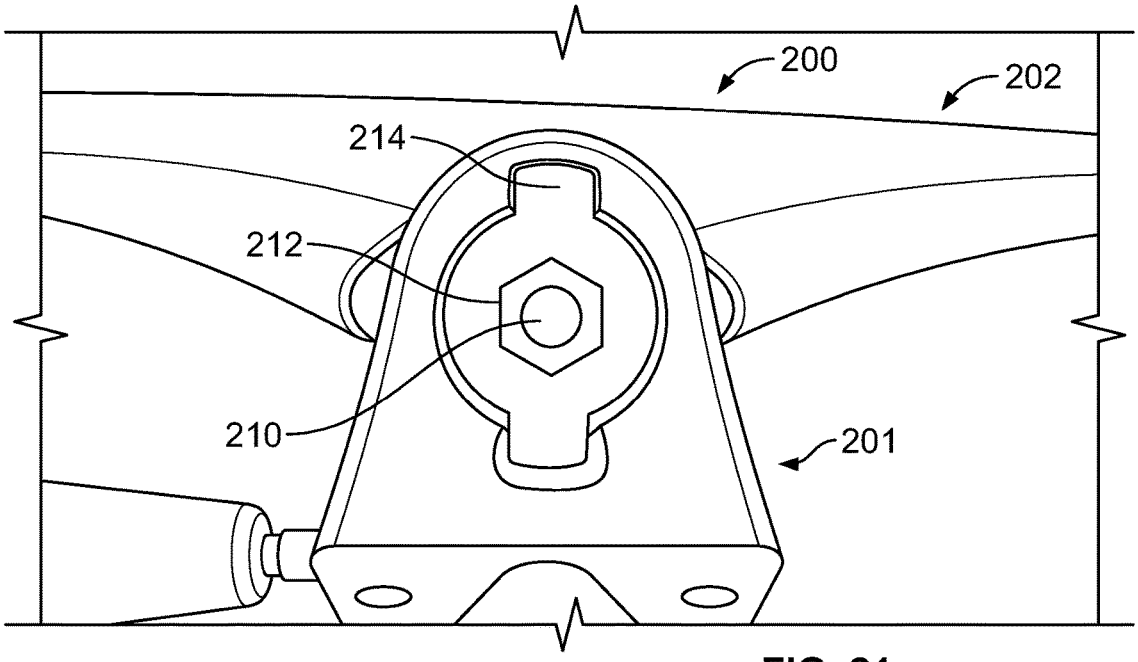
FIG. 21 is a detailed view of a base plate and locking key of an exemplary skateboard truck assembly according to the present disclosure.
Figure 22:
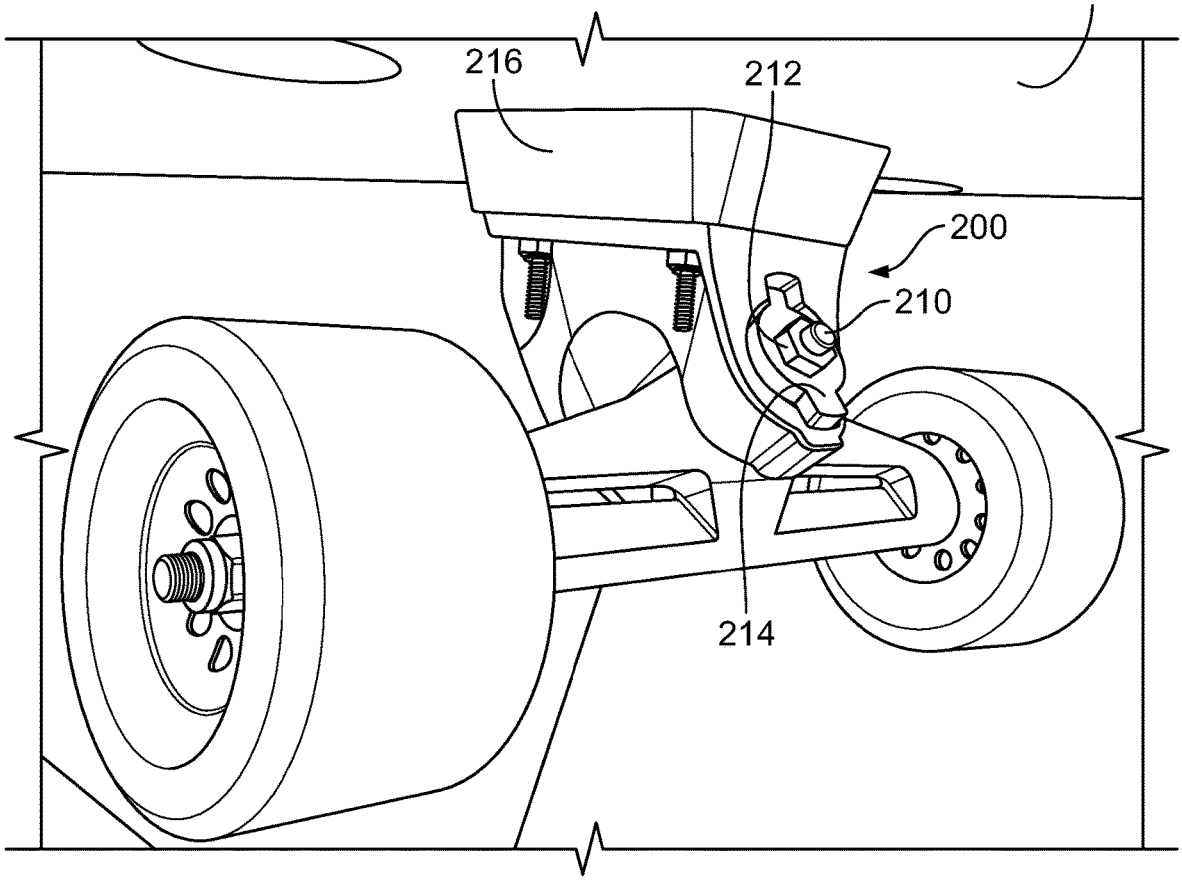
FIG. 22 is a perspective view of an exemplary skateboard truck assembly mounted to a deck according to the present disclosure.

FIGS. 21 and 22 show a detailed view of the assembly 200 and the assembly 200 mounted to a deck 206. In particular, FIGS. 21 and 22 show the kingpin 210, nut 212, and locking key 214, with the locking key 214 engaged with the wave cam (not visible). In some embodiments, the endpoint of the kingpin 210 that receives the nut 212 can include outer threads that extend a length of only between approximately 6 mm to approximately 12 mm, approximately 8 mm to approximately 10 mm, approximately 7 mm, approximately 9 mm, or the like from the endpoint. Particularly, the length of the threads on the kingpin 210 can be formed or selected such that the nut 212 can only be tightened up to the preferred tuning location, and prevent the nut 212 from being tightened further. The reduced length of the threads on the kingpin 210 prevent the kingpin 210 from being overtightened, resulting in an improved tuning process and removing operator error that results from overtightening of the kingpin 210. By providing an upper limit to how far the nut 212 can be tightened on the kingpin 210, prevention of structural strain or stress on the base plate is achieved. As shown in FIG. 22, the assembly 200 can be mounted to an extension 216 at the bottom of the deck 206. In some embodiments, a riser block can be mounted between the assembly 200 and the extension 216 to provide for additional clearance between the wheels and the deck 206. It should be understood that the assembly 100 can be similarly mounted to the deck 206.

As disclosed herein, the exemplary base plate of the truck assembly provides a greater structural strength during use in skateboard or longboard applications. Particularly, the uninterrupted and substantially uniform outer perimeter surface of the second pivot cup removes the weak structural point in the pivot cup, and instead transfers the weakest structural point to the wave cam (e.g., an easily replaceable and cheap plastic component). Thus, rather than structurally failing at the base plate, the exemplary truck assembly ensures the structural integrity of the base plate during use of the truck assembly. The structure of the second pivot cup further provides a safer ride by preventing pieces of a fractured wave cam from falling out of the assembly.

Figure 23:
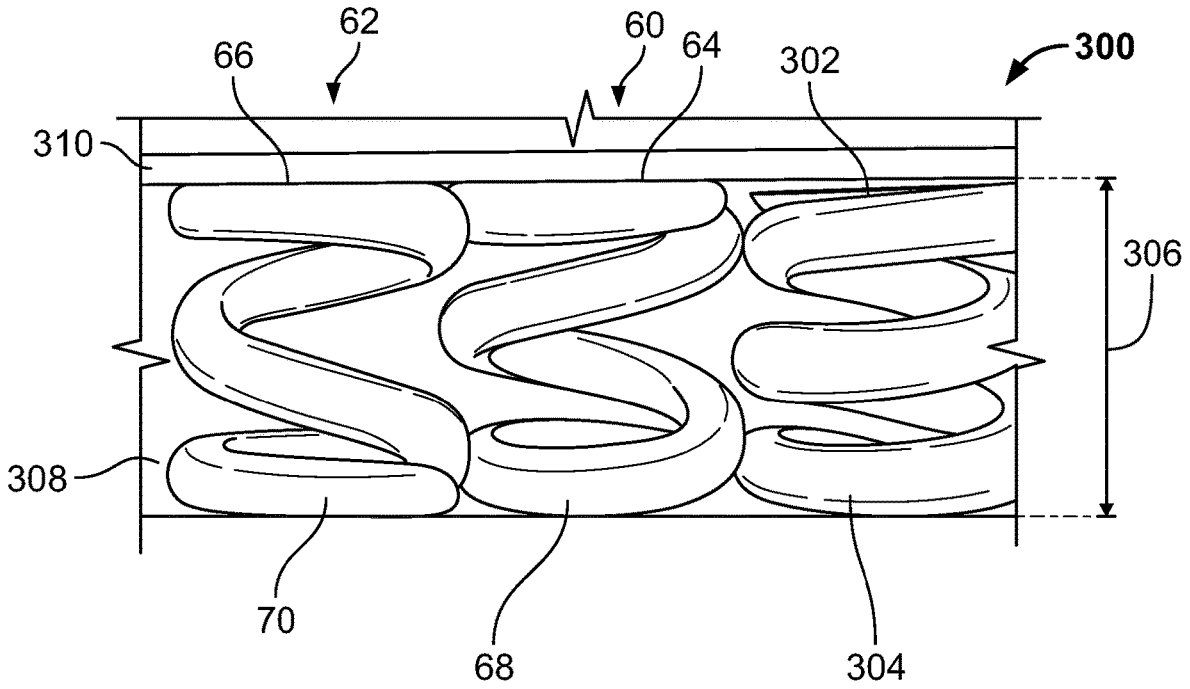
FIG. 23 is a front view of an exemplary spring for a skateboard truck assembly as compared to traditional springs prior to compression.

FIG. 23 shows front views of an exemplary spring 300 for a skateboard truck assembly as compared to traditional springs 60, 62 before compression. The traditional springs 60, 62 and the exemplary spring 300 each include top and bottom surfaces 64-70, 302, 304. To provide a visual indicator for the change in overall height 306 of the springs 60, 62, 300, the springs 60, 62, 300 are placed between a bottom surface 308 and a two foot level 310.

Traditional compression springs 60, 62 each include music wire coils that form approximately three full 360° turns, with an overall length of approximately 1 inch (nominal), and an outside diameter of approximately 1.3 inches. Music wire can have a diameter in the range from about 0.225 inches to about 0.250 inches. At full load, compression springs generally provide from about 15 lbf to about 25 lbf of restorative force. Spring 60 is formed from a wire with a diameter of approximately 0.243 inches and spring 62 is formed from a wire of approximately 0.225 inches. Both traditional springs 60, 62 have a safe travel of about 0.1 inches.

As discussed herein, a safe travel of a spring characterizes the amount that a specific spring can be compressed or elongated "safely". Music wire compression springs of this nature are linearly elastic at approximately 15% to approximately 85% of their safe travel. If the safe travel (e.g., limit) is exceeded (if a spring is compressed too far), the spring will not return to its original length. This is referred to as "compressive set". After a spring experiences compressive set, the spring has different elastic properties, usually with lower load bearing ability and lower safe travel. The change in load bearing ability and safe travel are not easily predictable.

The "Total Travel" of a compression spring can be measured as the amount of distance the spring can be compressed until all of the coils touch each other. For the springs 60, 62, the Total Travel can be about 0.325 in and about 0.271 in, respectively. However, the Safe Travel for the springs 60, 62 is only about 0.125 in and about 0.095 in, respectively.

A "Safe Travel" of a compression spring characterizes the axial distance that a specific spring can be compressed without yield. Music wire compression springs are generally linearly elastic within about 15% to about 85% of their Safe Travel. If the Safe Travel is exceeded, the spring may not return to its original uncompressed length (generally referred to as compressive set). After a spring experiences compressive set, the spring generally has a shorter uncompressed length, can be deformed, and exhibits reduced restorative forces and lower Safe Travel. The reduction in load bearing ability and Safe Travel caused by the compressive set are not easily predicted or anticipated.

Traditional spring-assisted trucks generally implement a spring preload up to about 0.050 in plus an additional 0.185 in Travel (0.235 in total), all of which must be Safe Travel. Based on performed experimentation, traditional springs were found to have adequate Total Travel, but their Safe Travel was less than about 0.100 in (i.e., half of the required 0.235 in). Consequently, traditional compression springs experience compressive set in spring-assisted trucks.

A known deficiency in traditional spring trucks is that the springs wear out due to compressive set. When the springs no longer return to their preload, the trucks can feel sloppy. When the springs feel sloppy, users tend to tighten down on the kingpin bolt to achieve preload. However, with the reduced distance inside the mechanism, the hanger is no longer able to reach its full range of motion and the elemental components break. With a spring truck having an overly tightened kingpin, when the user makes a steep turn, the top half of the wave cam cracks first. If the rider continues to make steep turns with a broken wave cam, the pivot cup can break at the locktab slot. If the rider continues to ride the board with a broken pivot cup, the hanger tabs can shear off, the locktab can break, and/or the hanger post can shear off. Improved springs are disclosed herein.

Figure 24:
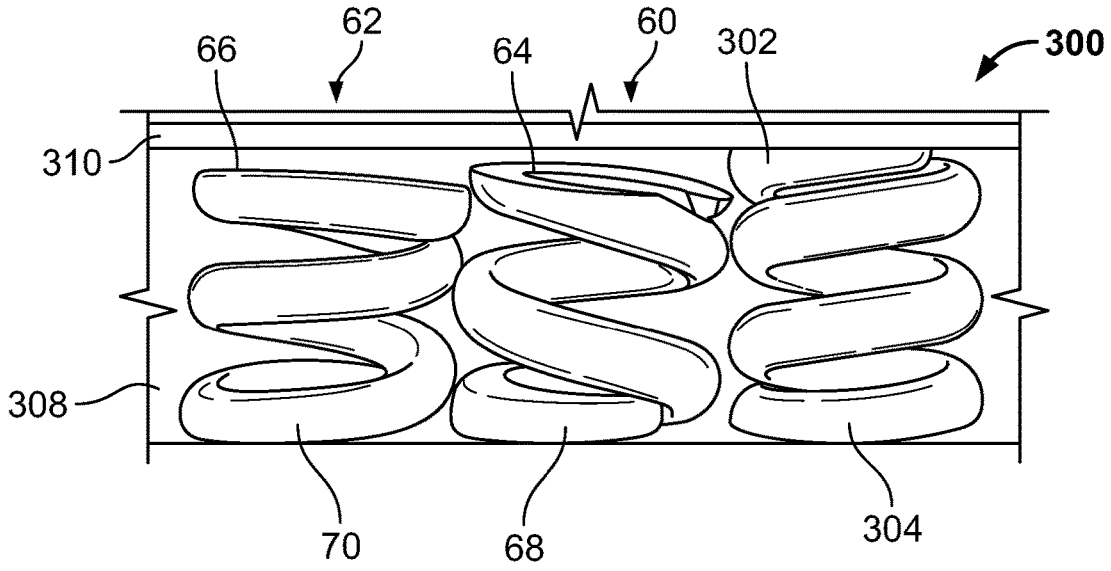
FIG. 24 is a front view of an exemplary sprint for a skateboard truck assembly as compared to traditional springs after compression.

FIG. 24 shows front views of the springs 60, 62, 300 of FIG. 23, after each spring 60, 62, 300 was fully compressed in a bench vice. The top surfaces 64, 66 of traditional springs 60, 62 are lower than the top surface 302 of exemplary spring 300. FIG. 24 therefore illustrates how the traditional springs 60, 62 suffered compressive set while the exemplary spring 300 does not.

The safe travel generally necessitated by the exemplary assembly 100 can be between approximately 0.20 inches to approximately 0.25 inches. Since the traditional springs 60, 62 have about half the required safe travel of the assembly 100 and traditional trucks 10, if used with the assembly 100, the traditional springs 60, 62 always exceed safe travel. The traditional springs 60, 62 suffer compressive set (on the order of approximately 10%) thereby leaving an unstable mechanism. This instability manifests itself as "loose ride" at low speeds and "speed wobble" at high speeds, both potentially unsafe conditions. Speed wobble is a well-known complaint for traditional spring trucks.

The exemplary spring 300 includes music wire coils that form approximately three and a half 360° turns, with an overall length of approximately 1 inch or approximately 1.1 inches, and an outside diameter of approximately 1.3 inches. The exemplary compression spring 300 has a safe travel of approximately 0.25 inches. The larger safe travel of the spring 300 eliminates instability leaving a "responsive ride" at low speeds and less likelihood of "speed wobble" at high speeds. Particularly, because the safe travel of the assembly 100 is between approximately 0.20 inches to approximately 0.25 inches, the safe travel of the spring 300 ensures that the spring 300 will not undergo compressive set and returns to its original length. In some embodiments, the resistive force provided by the spring 300 can be, e.g., approximately 15 lbs, approximately 20 lbs, approximately 25 lbs, or the like.

In some embodiments, the improved spring 300 can be fabricated by a special technique called "set removal", in which the spring 300 is formed to a penultimate length, compressed fully, and then released to a new ultimate length. The improved safe travel of spring 300 results in 3.5 turns in the same space as compared to the traditional springs 60, 62 which have three turns, thereby reducing the total travel length of spring 300 (as compared to traditional springs 60, 62). To accommodate the reduced travel length, a fender washer from between the spring 300 and the base plate can be removed, thereby creating about 2 mm of extra length for the mechanism.

Figure 25:
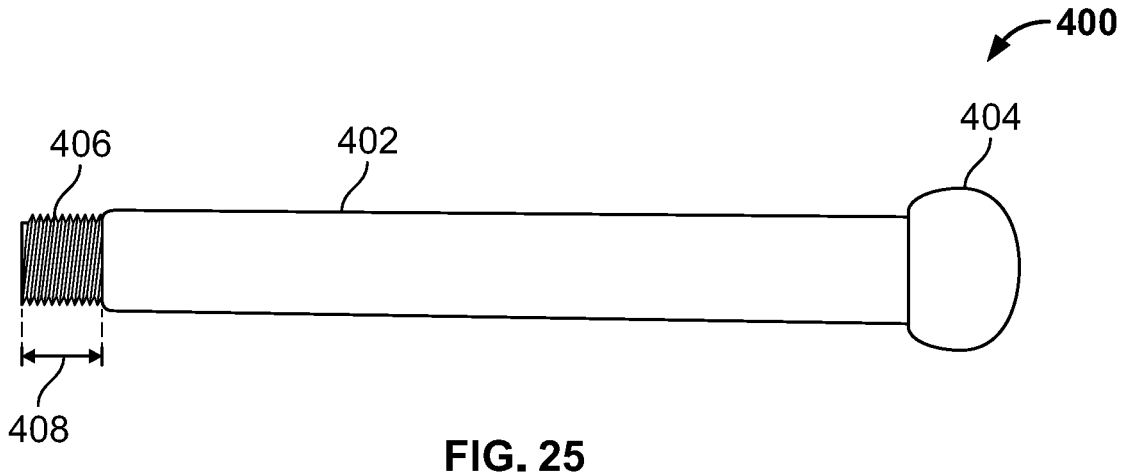
FIG. 25 is a side view of an exemplary kingpin for a skateboard truck assembly.

FIG. 25 is a side view of an exemplary kingpin 400 to be used with the exemplary skateboard truck assembly discussed herein. The kingpin 400 includes an elongated main body portion 402 with a head 404 on one end and a threaded section 406 on the opposing end. In some embodiments, the length 408 of the threaded section 406 as measured from the endpoint of the kingpin 400 can be dimensioned within a range of approximately 5 mm to approximately 15 mm. In some embodiments, the length 408 can be dimensioned as approximately 7 mm (e.g., limited in length relative to traditional kingpins). In some embodiments, the length 408 can be dimensioned such that sufficient threads are provided to engage with the nut (e.g., nut 212) and maintain the components of the skateboard truck assembly together, as well as reaching the desired tune of the assembly. The reduced length of the threads on the kingpin 400 prevent the kingpin 400 from being overtightened, resulting in an improved tuning process and removing operator error that results from overtightening of the kingpin 400. Particularly, the length 408 is dimensioned such that when the nut is fully threaded onto the threaded section 406 and is prevented from being threaded further, the desired tune of the assembly is reached. Because the nut cannot be threaded further, overtightening and improper tuning of the assembly is prevented.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A base plate for a skateboard, comprising:

a body including a proximal end and a distal end;

a first pivot cup extending from the body at or near the distal end; and a second pivot cup spaced from the first pivot cup and extending from the body at or near the proximal end, the second pivot cup (i) defining an outer perimeter surface having an uninterrupted height, a thickness of the uninterrupted height of the second pivot cup dimensioned greater than a thickness of the first pivot cup, (ii) includes an opening extending therethrough and surrounded by the outer perimeter surface of the second pivot cup, the opening of the second pivot cup configured to at least partially receive therein a wave cam such that the wave cam is surrounded by the outer perimeter surface of the second pivot cup, and (iii) includes one or more channels extending from the opening and through at least a portion of the second pivot cup, the one or more channels extending through at least the portion of the second pivot cup without extending through the outer perimeter surface.

2. The base plate of claim 1, wherein the outer perimeter surface of the second pivot cup defines a substantially uniform height.

3. The base plate of claim 1, wherein the one or more channels are configured to receive an extension of a locking key.

4. The base plate of claim 1, wherein the second pivot cup includes two channels on opposing sides of the opening and extending through at least a portion of the second pivot cup.

5. The base plate of claim 1, wherein the first pivot cup includes an opening extending therethrough and configured to receive a kingpin.

6. The base plate of claim 1, wherein the body includes a base configured to be mounted to a deck of the skateboard, and the first and second pivot cups are angled relative to the base of the body.

7. The base plate of claim 1, wherein the second pivot cup includes an inner surface facing the first pivot cup and an outer surface facing away from the first pivot cup, the outer surface of the second pivot cup curved inwardly in a concave manner.

8. A base plate for a skateboard, comprising:

a body including a proximal end and a distal end;

a first pivot cup extending from the body at or near the distal end; and a second pivot cup spaced from the first pivot cup and extending from the body at or near the proximal end, the second pivot cup (i) defining an outer perimeter surface, includes an opening extending therethrough and surrounded by the outer perimeter surface of the second pivot cup, the opening of the second pivot cup configured to at least partially receive therein a wave cam such that the wave cam is surrounded by the outer perimeter surface of the second pivot cup, and (iii) includes a channel extending from the opening and through at least a portion of the second pivot cup without extending through the outer perimeter surface.

9. The base plate of claim 8, wherein the outer perimeter surface of the second pivot cup defines a substantially uniform height, the uniform height of the second pivot cup dimensioned greater than a height of the first pivot cup.

10. The base plate of claim 8, wherein the one or more channels are configured to receive an extension of a locking key.

11. The base plate of claim 8, wherein the second pivot cup includes two channels on opposing sides of the opening and extending through at least a portion of the second pivot cup.

12. The base plate of claim 8, wherein the first pivot cup includes an opening extending therethrough and configured to receive a kingpin.

13. The base plate of claim 8, wherein the body includes a base configured to be mounted to a deck of the skateboard.

14. A truck for a skateboard, comprising:

a base plate comprising:

a body including a proximal end and a distal end;

a first pivot cup extending from the body at or near the distal end; and a second pivot cup spaced from the first pivot cup and extending from the body at or near the proximal end, the second pivot cup (i) defining an outer perimeter surface having an uninterrupted height, a thickness of the uninterrupted height of the second pivot cup dimensioned greater than a thickness of the first pivot cup, (ii) includes an opening extending therethrough and surrounded by the outer perimeter surface of the second pivot cup, the opening of the second pivot cup configured to at least partially receive therein a wave cam such that the wave cam is surrounded by the outer perimeter surface of the second pivot cup, and (iii) includes one or more channels extending from the opening and through at least a portion of the second pivot cup, the one or more channels extending through at least the portion of the second pivot cup without extending through the outer perimeter surface; and a hanger movably mounted between the first and second pivot cups of the base plate.

15. The truck of claim 14, wherein the outer perimeter surface of the second pivot cup defines a substantially uniform height.

16. The truck of claim 14, comprising a spring disposed between the hanger and the first pivot cup.

17. The truck of claim 16, wherein the spring is a compression spring with a safe travel configured to eliminate compressive set.

18. The truck of claim 14, comprising a locking key engaged with the wave cam.

19. The truck of claim 18, comprising a kingpin extending through the first pivot cup, the second pivot cup, the locking key, and the wave cam, the kingpin including a threaded section configured to engage with a nut to maintain assembly of and tune the base plate, the hanger, a spring and the wave cam, the threaded section of the kingpin limited in length to prevent overtightening of the assembly.

20. The truck of claim 14, wherein the second pivot cup includes an inner surface facing the first pivot cup and an outer surface facing away from the first pivot cup, the outer surface of the second pivot cup curved inwardly in a concave manner.

* * * * *